US012599246B2

(12) United States Patent
Lewis

(10) Patent No.: US 12,599,246 B2
(45) **Date of Patent: *Apr. 14, 2026**

(54) BED SHEET RETENTION SYSTEMS, SYSTEM COMPONENTS, AND METHODS OF MAKING AND USING THE SAME

(71) Applicant: Travis R. Lewis, Valdosta, GA (US)

(72) Inventor: Travis R. Lewis, Valdosta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/286,059

(22) Filed: Jul. 30, 2025

(65) Prior Publication Data

US 2025/0359684 A1 Nov. 27, 2025

Related U.S. Application Data

(60) Division of application No. 19/086,324, filed on Mar. 21, 2025, now Pat. No. 12,390,016, which is a continuation of application No. 18/986,848, filed on Dec. 19, 2024, which is a continuation of application No. 18/945,224, filed on Nov. 12, 2024, which is a continuation-in-part of application No. PCT/US2023/079473, filed on Nov. 13, 2023.

(60) Provisional application No. 63/426,859, filed on Nov. 12, 2022.

(51) Int. Cl.
*A47C 21/02* (2006.01)

(52) U.S. Cl.
CPC ..... *A47C 21/022* (2013.01)

(58) Field of Classification Search
CPC ..... A47C 21/022; A47C 21/02; A47C 21/028; A47C 21/024; A47C 21/00; Y10T 24/23; Y10T 24/44043; Y10T 24/4406
USPC ..... 24/72.5
See application file for complete search history.

(56) References Cited

U.S. PATENT DOCUMENTS

| | | | | | |
|---|---|---|---|---|---|
| 959,763 | A | * | 5/1910 | Leher | A47C 21/022 24/72.5 |
| 1,465,323 | A | | 8/1923 | Hove | |
| 1,468,624 | A | | 9/1923 | Bennett | |
| 1,728,235 | A | * | 9/1929 | Findura | A47C 21/022 160/391 |
| 2,103,244 | A | | 12/1937 | Briscoe | |
| 2,154,557 | A | * | 4/1939 | Bechik | A47C 21/026 5/411 |
| 2,426,769 | A | | 9/1947 | Gould | |
| 2,507,091 | A | | 5/1950 | Carlson | |
| 2,826,766 | A | | 3/1958 | Stoner | |
| 3,045,310 | A | | 7/1962 | Velinsky | |
| 4,072,231 | A | | 2/1978 | Helms | |
| 4,107,826 | A | * | 8/1978 | Tysdal | F16B 5/0692 160/395 |
| 4,199,831 | A | | 4/1980 | Muller | |
| 4,276,667 | A | | 7/1981 | Osbourne | |

(Continued)

FOREIGN PATENT DOCUMENTS

| | | | |
|---|---|---|---|
| CH | 231224 | A | 3/1944 |
| CN | 2819947 | Y | 9/2006 |

(Continued)

*Primary Examiner* — Jason W San
*Assistant Examiner* — Louis A Mercado

(57) ABSTRACT

Bed sheet retention devices, bed sheet retention systems, and system components, are disclosed. Methods of making and using bed sheet retention devices, bed sheet retention systems, and system components are also disclosed.

20 Claims, 25 Drawing Sheets

(56) References Cited

U.S. PATENT DOCUMENTS

| | | | | | |
|---|---|---|---|---|---|
| 4,467,504 | A | * | 8/1984 | Quist | F16B 5/0692 24/72.5 |
| 4,539,723 | A | * | 9/1985 | Hillsberry | A47C 27/085 24/72.5 |
| 4,541,137 | A | | 9/1985 | Murray | |
| 4,698,880 | A | * | 10/1987 | Hamm | A47C 21/022 24/72.5 |
| 4,712,262 | A | | 12/1987 | Viggiano | |
| 4,736,478 | A | | 4/1988 | Dangerously | |
| 4,769,865 | A | * | 9/1988 | Delaino | A47C 27/085 24/72.5 |
| 4,773,108 | A | * | 9/1988 | Leever | A47C 21/022 24/72.5 |
| 4,833,744 | A | | 5/1989 | Correa | |
| 5,016,306 | A | | 5/1991 | Grivna et al. | |
| 5,044,028 | A | | 9/1991 | Sleeth | |
| 5,095,591 | A | | 3/1992 | Hubscher | |
| 5,131,104 | A | | 7/1992 | Larson | |
| 5,182,827 | A | | 2/1993 | Carrier et al. | |
| 5,218,729 | A | | 6/1993 | Walton | |
| 5,404,601 | A | | 4/1995 | O'Neill et al. | |
| D384,585 | S | | 10/1997 | Swarr | |
| 5,749,512 | A | * | 5/1998 | Gingras-Taylor | B65D 5/445 229/199 |
| D560,485 | S | | 1/2008 | Lavelle | |
| 7,370,588 | B2 | | 5/2008 | Franco | |
| D573,013 | S | | 7/2008 | Lavelle | |
| 7,395,567 | B1 | | 7/2008 | Tetzler | |
| 7,467,428 | B2 | | 12/2008 | Hanes | |
| D647,212 | S | | 10/2011 | Lavelle | |
| D660,454 | S | | 5/2012 | Lavelle | |
| 8,286,282 | B2 | | 10/2012 | Kummer et al. | |
| D673,853 | S | | 1/2013 | Burns | |
| D709,360 | S | | 7/2014 | Lavelle | |
| 9,854,920 | B1 | | 1/2018 | Welborn et al. | |
| 10,786,088 | B2 | * | 9/2020 | Herskovic | A47C 21/022 |
| D898,553 | S | | 10/2020 | Trombley | |
| D937,268 | S | | 11/2021 | Jourson | |
| 2002/0062524 | A1 | | 5/2002 | Vogland et al. | |
| 2005/0125903 | A1 | | 6/2005 | Tapanes | |
| 2007/0000100 | A1 | | 1/2007 | Smith | |
| 2014/0026318 | A1 | | 1/2014 | Bethel | |
| 2015/0342359 | A1 | | 12/2015 | Molina | |
| 2016/0242559 | A1 | * | 8/2016 | Hui | A47G 9/0246 |
| 2020/0100968 | A1 | | 4/2020 | Ribble | |
| 2020/0245775 | A1 | | 8/2020 | Baker | |
| 2023/0017278 | A1 | | 1/2023 | Piquer | |
| 2024/0374041 | A1 | | 11/2024 | Tar et al. | |

FOREIGN PATENT DOCUMENTS

| | | |
|---|---|---|
| DE | 9200398 | 3/1992 |
| WO | 9848673 | 11/1998 |

* cited by examiner

BED SHEET RETENTION SYSTEMS, SYSTEM COMPONENTS, AND METHODS OF MAKING AND USING THE SAME

This patent application is a continuation patent application of U.S. Utility patent application Ser. No. 19/086,324 entitled "BED SHEET RETENTION SYSTEMS, SYSTEM COMPONENTS, AND METHODS OF MAKING AND USING THE SAME" filed on Mar. 21, 2025, now U.S. Pat. No. 12,390,016, which is a continuation patent application of, and claims the benefit of priority to, U.S. patent application Ser. No. 18/986,848 filed on Dec. 19, 2024 and entitled "BED SHEET RETENTION SYSTEMS, SYSTEM COMPONENTS, AND METHODS OF MAKING AND USING THE SAME," which is a continuation patent application of, and claims the benefit of priority to, U.S. patent application Ser. No. 18/945,224 filed on Nov. 12, 2024 and entitled "BED SHEET RETENTION SYSTEMS, SYSTEM COMPONENTS, AND METHODS OF MAKING AND USING THE SAME," which is a continuation-in-part patent application that claims the benefit of priority to PCT International Patent Application No. PCT/US2023/079473 filed on Nov. 13, 2023 and entitled "BED SHEET RETENTION SYSTEMS AND METHODS OF MAKING AND USING THE SAME," which claims the benefit of priority to U.S. Provisional Patent Application Ser. No. 63/426,859 filed on Nov. 21, 2022 and entitled "BED SHEET RETENTION SYSTEMS AND METHODS OF MAKING AND USING THE SAME," the subject matter of all of which is hereby incorporated by reference in its entirety.

FIELD OF THE INVENTION

The present invention relates to bed sheet retention devices, and accessories that can be used with bed sheet retention devices, methods of making bed sheet retention devices, and accessories that can be used with bed sheet retention devices, and methods of using bed sheet retention devices, and accessories that can be used with bed sheet retention devices.

BACKGROUND OF THE INVENTION

Known sheet tensioning systems on the market rely on lifting the mattress and working underneath the corners on adjustments and holding the corners of the sheets down. There are elastic bands and such which are marketed to hold the sheets down, but tight bed sheets will come undone unless locked into place. Drawstring tension systems are present in the market, corner elastic suspender type tensioners are also available. Each of these are tedious on installations and settings, each requiring an adjustment depending on what size sheet and mattress you are working with.

Working with these sheet retention systems does not make bed making easier. In fact, such sheet retention systems make it more labor intensive. Such bed aids should not make fighting with bed sheets more difficult, and more of a frustration than the sheet coming off itself. Such a device should feel natural to use, as if it's not even there. It should be a part of the typical bed making process, and helpful in its design.

There is a need in the art for continued improvements in the art of bed sheet retention systems.

SUMMARY OF THE INVENTION

The present invention is directed to bed sheet retention devices, attachable accessories that can be used with and connected to bed sheet retention devices, and systems that prevent bed sheets from slipping off of a bed, such as in the corners of a bed mattress and/or along a side edge of the bed.

The present invention is directed to bed sheet retention devices. In some embodiments, the bed sheet retention device comprises: a bracket comprising: (a) a horizontally-extending bracket component sized and designed to extend between a bottom surface of a mattress and a support surface under the bottom surface; and (b) one or more sheet-engaging channels connected to said horizontally-extending bracket component, wherein each sheet-engaging channel (1) comprises a sheet-locking member extending along an outer surface of the bracket, and (2) extends substantially within a plane P parallel with said horizontally-extending bracket component or at an angle A to the plane P parallel with said horizontally-extending bracket component, wherein the sheet-locking member comprises (i) an upper sheet-locking channel member, and (ii) a lower sheet-locking channel member positioned below and spaced from said upper sheet-locking channel member, wherein each of said upper sheet-locking channel member and said lower sheet-locking channel member are designed to engage with one or more sheet locking strips and/or one or more of the herein-described attachable accessories.

In some embodiments, the bed sheet retention device of the present invention comprises a bed sheet retention device comprising: (I) a corner bracket comprising: (a) a horizontally-extending bracket component sized and designed to extend between a bottom surface of a mattress and a support surface under the bottom surface; and (b) two or more sheet-engaging channels connected to said horizontally-extending bracket component, said two or more sheet-engaging channels (1) being separated from one another by a corner of the corner bracket, and (2) extending substantially within a plane P parallel with said horizontally-extending bracket component or at an angle A to the plane P parallel with said horizontally-extending bracket component.

In some embodiments, the bed sheet retention device of the present invention comprises a bed sheet retention device comprising: (I) a corner bracket comprising: (a) a horizontally-extending bracket component sized and designed to extend between a bottom surface of a mattress and a support surface under the bottom surface; (b) one or more sheet-engaging channels connected to said horizontally-extending bracket component, wherein each sheet-engaging channel (1) comprises (a) two sheet-locking members, and (b) an open guided section extending around a corner of the corner bracket, and (2) extends substantially within a plane P parallel with said horizontally-extending bracket component or at an angle A to the plane P parallel with said horizontally-extending bracket component.

In some embodiments, the bed sheet retention devices of the present invention comprise: (I) a side bracket comprising: (a) a horizontally-extending bracket component sized and designed to extend between a bottom surface of a mattress and a support surface under the bottom surface; and (b) one or more sheet-engaging channels connected to said horizontally-extending bracket component, wherein each sheet-engaging channel (1) comprises a sheet-locking member extending along an outer surface of the side bracket, and (2) extends substantially within a plane P parallel with said horizontally-extending bracket component or at an angle A to the plane P parallel with said horizontally-extending bracket component.

The present invention is further directed to attachable accessories that can be used with and connected to bed sheet retention devices. The attachable accessories can be used to provide one or more bed sheet retention system features including, but not limited to, a shelf for placement of keys, phone, or any other object; a cup holder; a basket; a pouch; an electric cord holder; an electric fan support; a charging pad; a light support; an open net support; a closed net support; a jointed arm device that has a distal arm end that is movable and is designed to hold an object, e.g., a book, a phone, a computer pad, etc., a guardrail extending along a side edge of a bed, or any combination thereof.

The attachable accessories of the present invention are suitable for use with bed sheet retention devices, such as the bed sheet retention devices disclosed in International Patent Application No. PCT/US2023/079473, as well as the herein-described bed sheet retention devices. A given accessory may comprise: (a) at least one accessory connecting member, and (b) an accessory body connected to and extending from the at least one accessory connecting member, wherein the at least one accessory connecting member is configured to extend within and connect to one or more corner brackets and/or one or more side brackets of a bed sheet retention device.

The present invention is even further directed to bed sheet retention systems. In some embodiments, the bed sheet retention systems comprises: (I) a bracket comprising: (a) a horizontally-extending bracket component sized and designed to extend between a bottom surface of a mattress and a support surface under the bottom surface; and (b) one or more sheet-engaging channels connected to said horizontally-extending bracket component, wherein each sheet-engaging channel (1) comprises a sheet-locking member extending along an outer surface of the bracket, and (2) extends substantially within a plane P parallel with said horizontally-extending bracket component or at an angle A to the plane P parallel with said horizontally-extending bracket component, wherein the sheet-locking member comprises (i) an upper sheet-locking channel member, and a lower sheet-locking channel member positioned below and spaced from said upper sheet-locking channel member, wherein each of said upper sheet-locking channel member and said lower sheet-locking channel member are designed to engage with one or more sheet locking strips and/or one or more of the herein-described attachable accessories; and (II) one or more sheet locking strips, each sheet locking strip being sized and designed to engage with said upper sheet-locking channel member and said lower sheet-locking channel member of each of said one or more sheet-engaging channels of said bracket.

In some embodiments, the bed sheet retention systems comprise: (I) a bracket comprising: (a) a horizontally-extending bracket component sized and designed to extend between a bottom surface of a mattress and a support surface under the bottom surface; and (b) one or more sheet-engaging channels connected to said horizontally-extending bracket component, wherein each sheet-engaging channel (1) comprises a sheet-locking member extending along an outer surface of the bracket, and (2) extends substantially within a plane P parallel with said horizontally-extending bracket component or at an angle A to the plane P parallel with said horizontally-extending bracket component, wherein the sheet-locking member comprises (i) an upper sheet-locking channel member, and a lower sheet-locking channel member positioned below and spaced from said upper sheet-locking channel member, wherein each of said upper sheet-locking channel member and said lower sheet-locking channel member are designed to engage with one or more sheet locking strips and/or one or more of the herein-described attachable accessories; and (II) one or more of the herein-described attachable accessories, each accessory being sized and designed to engage with said upper sheet-locking channel member and said lower sheet-locking channel member of each of said one or more sheet-engaging channels of said bracket.

In some embodiments, the bed sheet retention systems of the present invention comprises (I) one or more bed sheet retention devices, wherein one or more of the bed sheet retention devices comprises: a corner bracket comprising: (a) a horizontally-extending bracket component sized and designed to extend between a bottom surface of a mattress and a support surface under the bottom surface; and (b) one or more sheet-engaging channels (1) connected to said horizontally-extending bracket component, and (2) extending substantially within a plane P parallel with said horizontally-extending bracket component, and (II) one or more sheet locking strips that engage with one or both of the one or more sheet-engaging channels. As discussed below, the bed sheet retention systems of the present invention may comprise four or more bed sheet retention devices, and four or more sheet locking strips, as well as other possible system/kit components including, but not limited to, one or more bed sheets.

In some embodiments, the disclosed bed sheet retention systems comprise (I) one or more bed sheet retention devices, wherein at least one bed sheet retention device comprises: (A) a side bracket comprising: (a) a horizontally-extending bracket component sized and designed to extend between a bottom surface of a mattress and a support surface under the bottom surface; and (b) one or more sheet-engaging channels connected to said horizontally-extending bracket component, wherein each sheet-engaging channel (1) comprises a sheet-locking member extending along an outer surface of the side bracket, and (2) extends substantially within a plane P parallel with said horizontally-extending bracket component or at an angle A to the plane P parallel with said horizontally-extending bracket component; and (II) one or more sheet locking strips that engage with one or more of the one or more sheet-engaging channels.

In some embodiments, the disclosed bed sheet retention systems further comprise (III) one or more accessories, wherein each accessory comprises (a) at least one accessory connecting member, and (b) an accessory body connected to and extending from the at least one accessory connecting member, wherein the at least one accessory connecting member is configured to extend within and connect to the one or more sheet-engaging channels of the side bracket. In some embodiments, the disclosed bed sheet retention system even further comprise (IV) one or more corner brackets as described in International Patent Application No. PCT/US2023/079473, the subject matter of which is incorporated herein by reference in its entirety.

The present invention is also directed to bed sheet retention systems comprising one or more of the herein-described accessories. In some embodiments, the disclosed bed sheet retention systems comprise (I) one or more bed sheet retention devices, wherein at least one bed sheet retention device comprises: a side bracket comprising: (a) a horizontally-extending bracket component sized and designed to extend between a bottom surface of a mattress and a support surface under the bottom surface; and (b) one or more sheet-engaging channels connected to said horizontally-extending bracket component, wherein each sheet-engaging channel (1) comprises a sheet-locking member extending along an outer surface of the side bracket, and (2) extends substantially within a plane P parallel with said horizontally-extending bracket component or at an angle A to the plane P parallel with said horizontally-extending bracket component; and (II) one or more accessories, wherein each accessory comprises (a) at least one accessory connecting member, and (b) an accessory body connected to and extending from the at least one accessory connecting member, wherein the at least one accessory connecting member is configured to extend within and connect to the one or more sheet-engaging channels of the side bracket.

In other embodiments, the disclosed bed sheet retention systems comprise (I) one or more bed sheet retention devices, wherein at least one bed sheet retention device comprises: a side bracket comprising: (a) a horizontally-extending bracket component sized and designed to extend between a bottom surface of a mattress and a support surface under the bottom surface; and (b) one or more sheet-engaging channels connected to said horizontally-extending bracket component, wherein each sheet-engaging channel (1) comprises a sheet-locking member extending along an outer surface of the side bracket, and (2) extends substantially within a plane P parallel with said horizontally-extending bracket component or at an angle A to the plane P parallel with said horizontally-extending bracket component; (II) one or more sheet locking strips that engage with one or both of the one or more sheet-engaging channels, and (III) one or more accessories, wherein each accessory comprises (a) at least one accessory connecting member, and (b) an accessory body connected to and extending from the at least one accessory connecting member, wherein the at least one accessory connecting member is configured to extend within and connect to the one or more sheet-engaging channels of the side bracket.

The present invention is even further directed to methods of making the herein-described bed sheet retention devices and accessories for bed sheet retention devices. In some embodiments, the method of making a bed sheet retention device comprises: forming a bed sheet retention device comprising: a corner bracket comprising: (a) a horizontally-extending bracket component sized and designed to extend between a bottom surface of a mattress and a support surface under the bottom surface; and (b) one or more sheet-engaging channels connected to the horizontally-extending bracket component, wherein each sheet-engaging channel (1) comprises (a) two sheet-locking members, and (b) an open guided section extending around a corner of the corner bracket, and (2) extends substantially within a plane P parallel with the horizontally-extending bracket component or at an angle A to the plane P parallel with said horizontally-extending bracket component, said forming step utilizing one or more steps comprising: one or more thermoforming steps (e.g., a molding steps); one or more machining steps (e.g., one or more drilling, cutting, stamping, sanding, abrading, etc., steps); and one or more assembling steps.

In some embodiments, the method of making a bed sheet retention device comprises: forming a bed sheet retention device comprising: a side bracket comprising: (a) a horizontally-extending bracket component sized and designed to extend between a bottom surface of a mattress and a support surface under the bottom surface; and (b) one or more sheet-engaging channels connected to the horizontally-extending bracket component, wherein each sheet-engaging channel (1) comprises a sheet-locking member extending along an outer surface of the side bracket, and (2) extends substantially within a plane P parallel with said horizontally-extending bracket component or at an angle A to the plane P parallel with said horizontally-extending bracket component, said forming step utilizing one or more steps comprising: one or more thermoforming steps (e.g., a molding steps); one or more machining steps (e.g., one or more drilling, cutting, stamping, sanding, abrading, etc., steps); and one or more assembling steps.

In some embodiments, the method of making an accessory comprises: forming an accessory comprising: (a) at least one accessory connecting member, and (b) an accessory body connected to and extending from the at least one accessory connecting member, wherein the at least one accessory connecting member is configured to extend within and connect to one or more side brackets of a bed sheet retention device, said forming step utilizing one or more steps comprising: one or more thermoforming steps (e.g., a molding steps); one or more machining steps (e.g., one or more drilling, cutting, stamping, sanding, abrading, etc., steps); and one or more assembling steps.

The present invention is even further directed to methods of using bed sheet retention devices and accessories with bed sheet retention devices. In some embodiments, the method of using a bed sheet retention device comprises: inserting a horizontally-extending bracket component of the bed sheet retention device between a bottom surface of a mattress and a support surface under the bottom surface; and engaging a sheet material with one or more sheet-engaging channels along a bed sheet retention device, wherein each sheet-engaging channel (1) comprises a sheet-locking member extending along an outer surface of a bracket, and (2) extends substantially within a plane P parallel with the horizontally-extending bracket component or at an angle A to the plane P parallel with said horizontally-extending bracket component, wherein the sheet-locking member comprises (i) an upper sheet-locking channel member, and a lower sheet-locking channel member positioned below and spaced from the upper sheet-locking channel member, wherein each of the upper sheet-locking channel member and the lower sheet-locking channel member are designed to engage with one or more sheet locking strips and/or one or more of the herein-described attachable accessories, said engaging step comprising inserting one or more sheet locking strips and/or one or more of the herein-described attachable accessories between the upper sheet-locking channel member and the lower sheet-locking channel member of the bracket.

In some embodiments, the method of using an accessory comprises: connecting an accessory to a corner or side bracket of a bed sheet retention device, the accessory comprising: (a) at least one accessory connecting member, and (b) an accessory body connected to and extending from the at least one accessory connecting member, wherein said connecting step comprises connecting the at least one accessory connecting member of the accessory to the corner or side bracket.

These and other features and advantages of the present invention will become apparent after a review of the following detailed description of the disclosed embodiments and the appended claims.

BRIEF DESCRIPTION OF THE FIGURES

The present invention is further described with reference to the appended figure, wherein.

Figure 1:
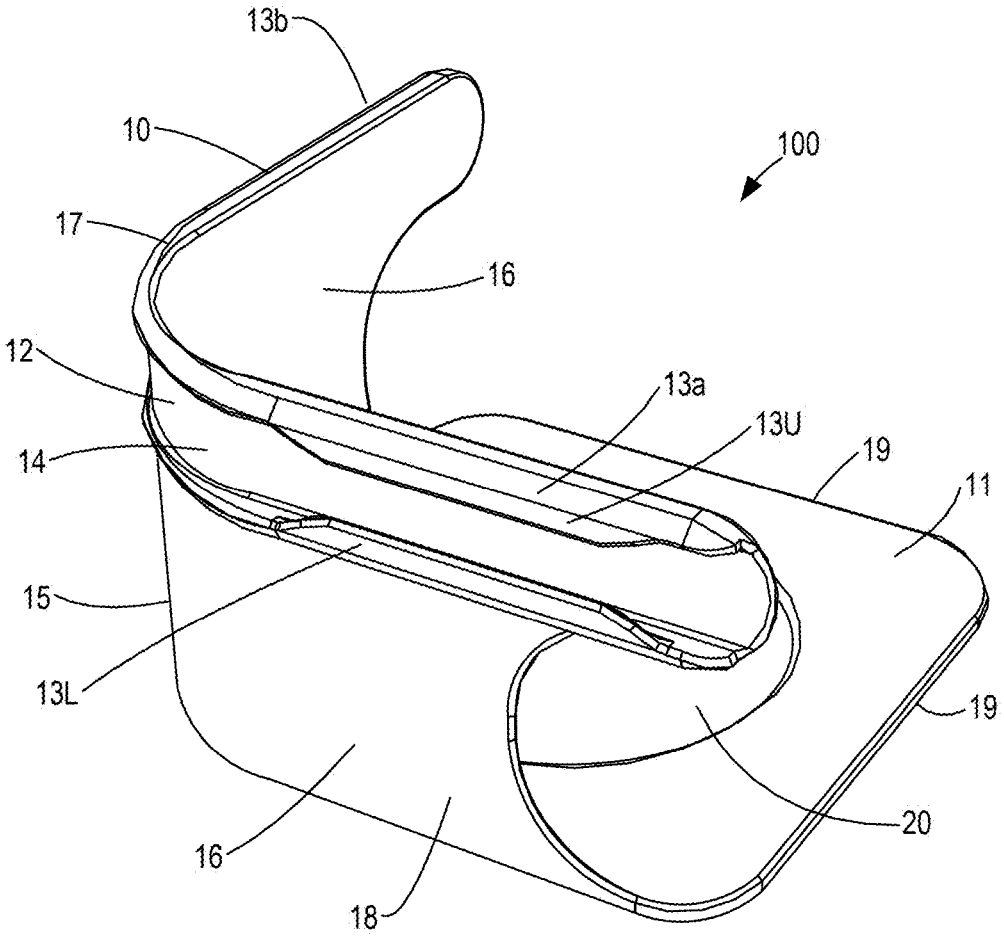
FIG. 1 depicts a perspective view of an exemplary bed sheet retention device suitable for use in the disclosed bed sheet retention systems.
Figure 2:
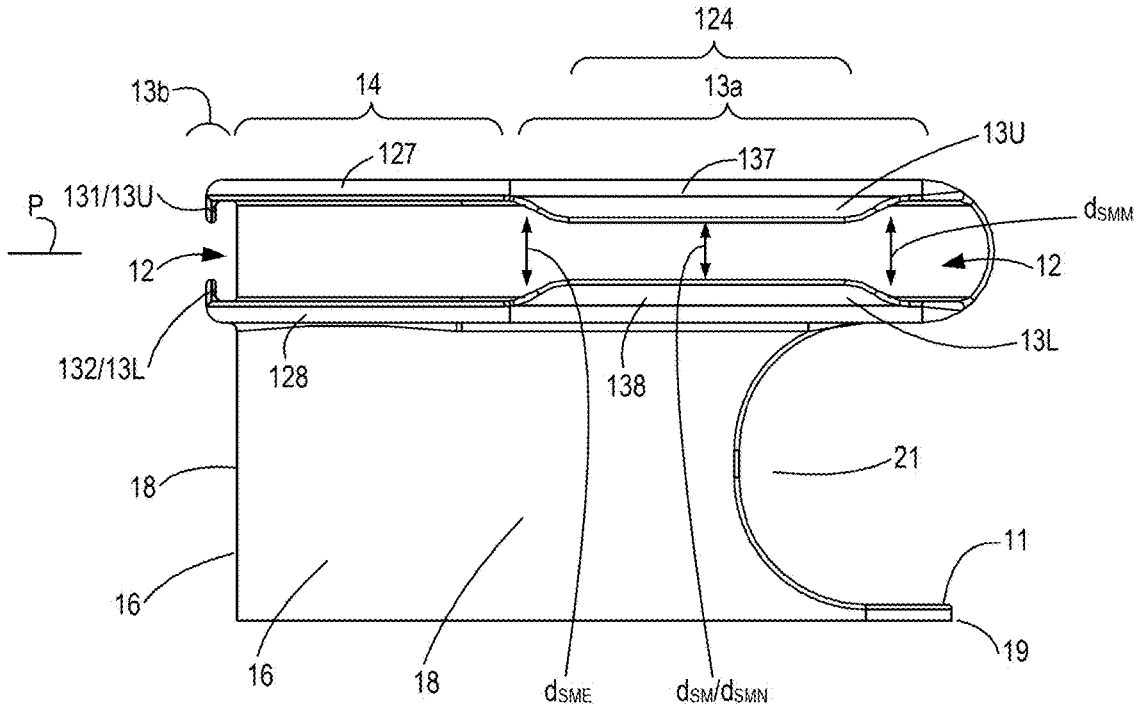
FIG. 2 depicts a front right-side view of the exemplary bed sheet retention device shown in FIG. 1.
Figure 3:
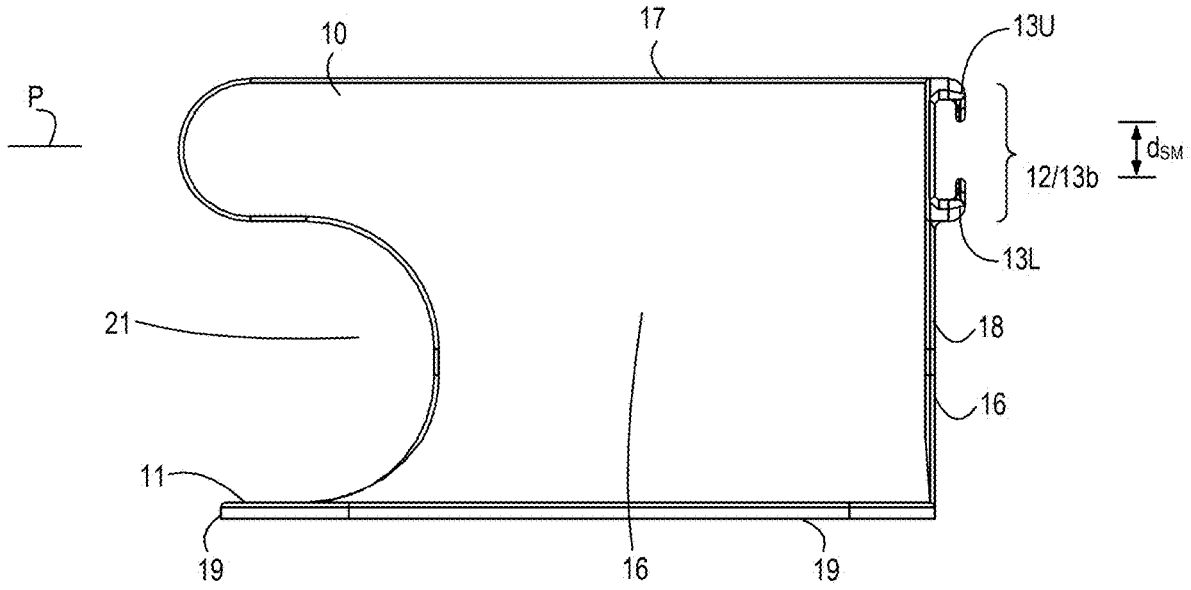
FIG. 3 depicts a rear left-side view of the exemplary bed sheet retention device shown in FIG. 1.
Figure 4:
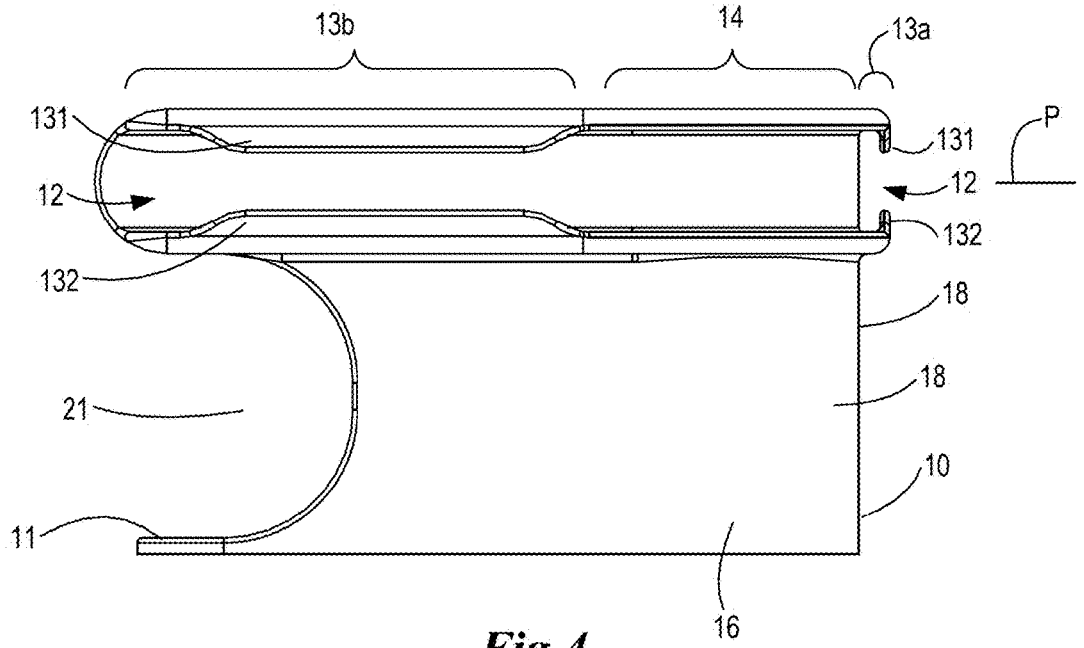
FIG. 4 depicts a front left-side view of the exemplary bed sheet retention device shown in FIG. 1.
Figure 5:
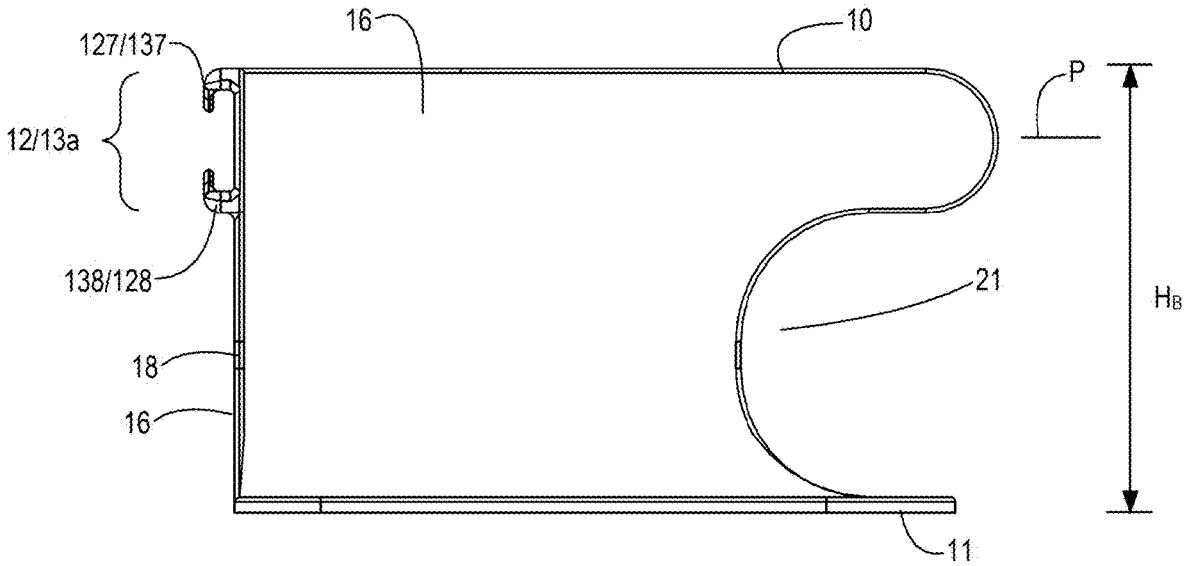
FIG. 5 depicts a rear right-side view of the exemplary bed sheet retention device shown in FIG. 1.
Figure 6:
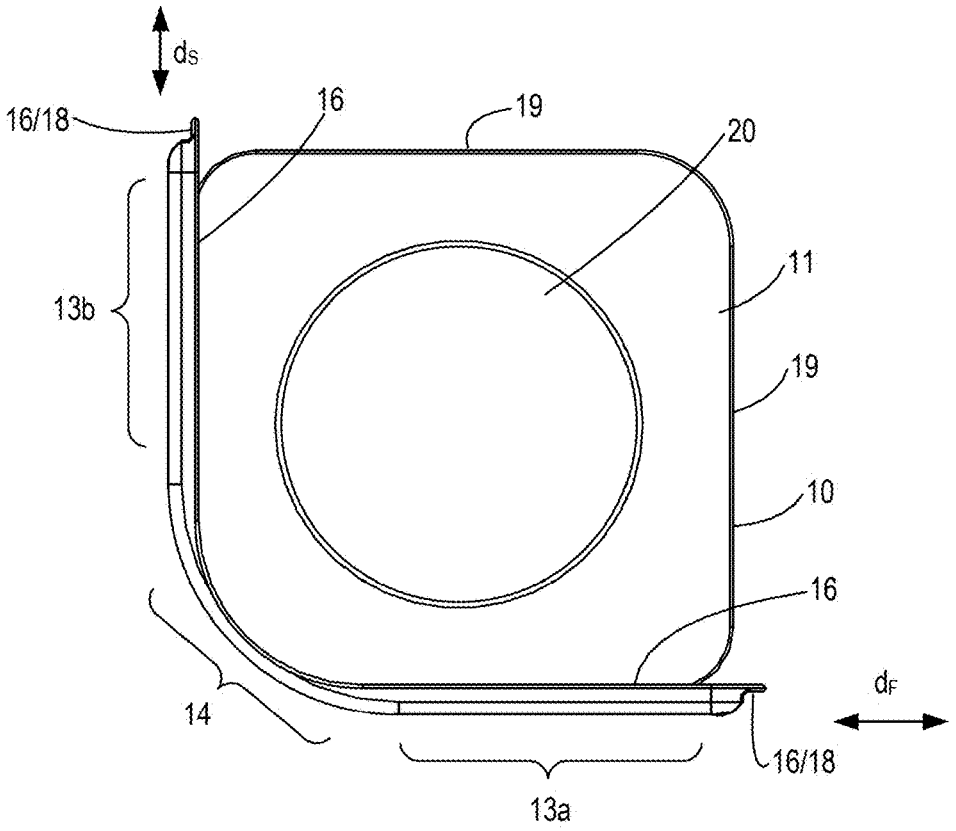
FIG. 6 depicts a top view of the exemplary bed sheet retention device shown in FIG. 1.
Figure 7:
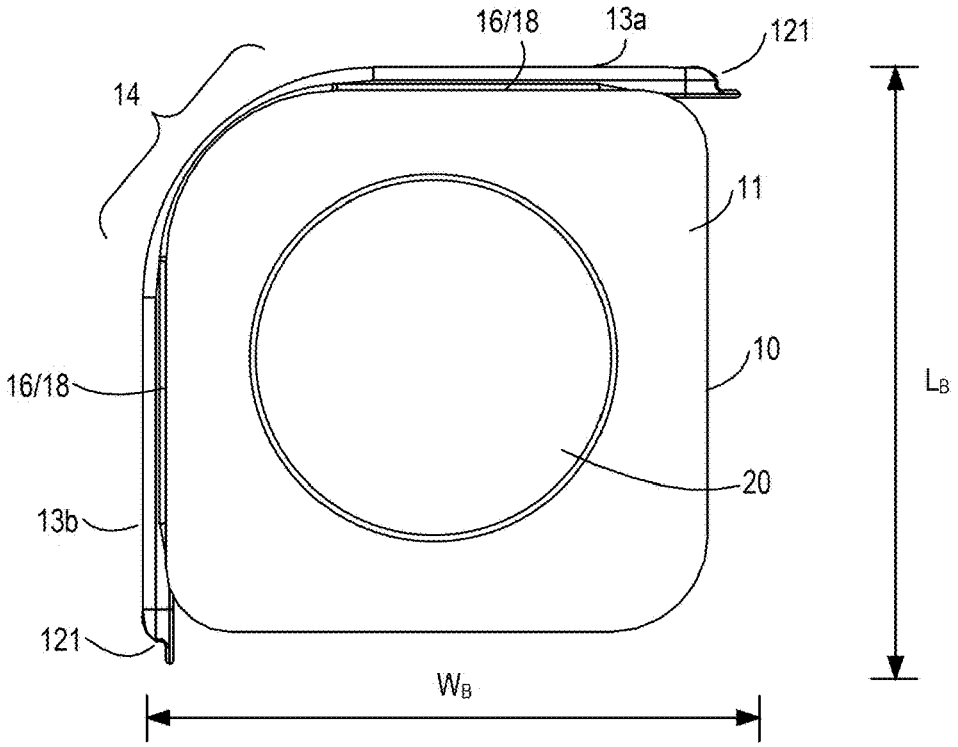
FIG. 7 depicts a bottom view of the exemplary bed sheet retention device shown in FIG. 1.
Figure 8:
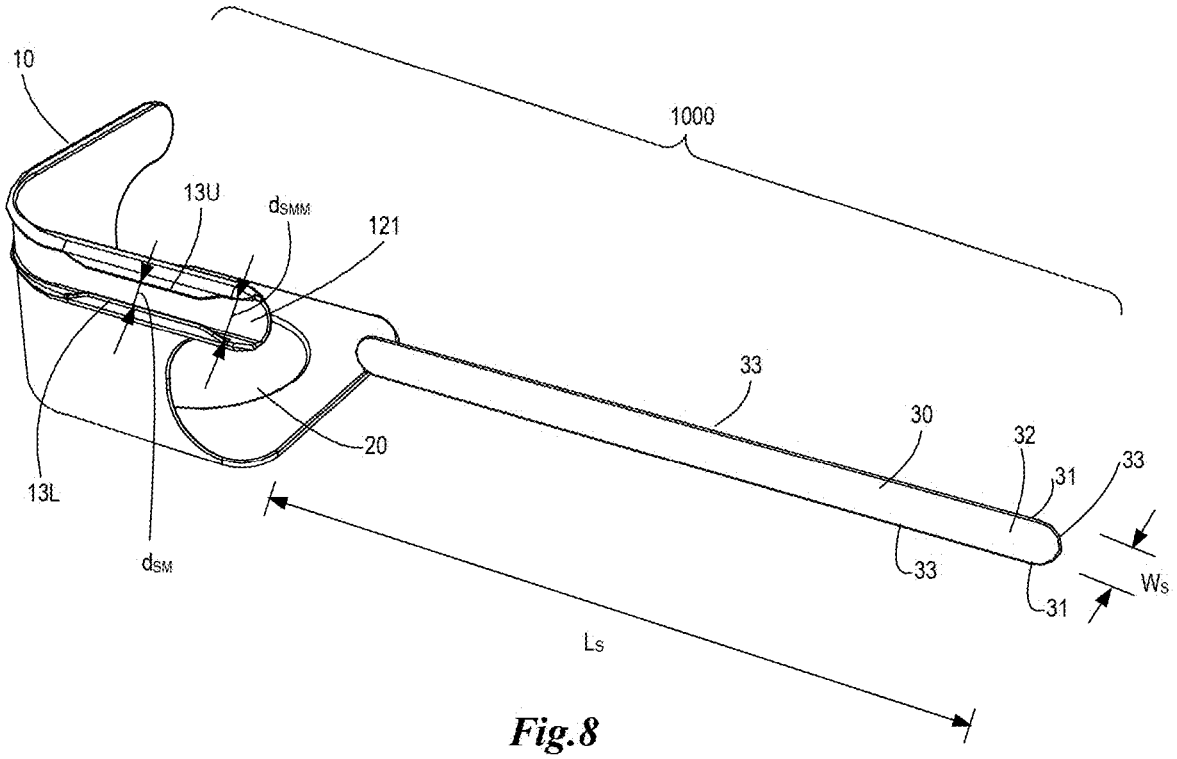
FIG. 8 depicts another perspective view of the exemplary bed sheet retention device shown in FIG. 1 showing a sheet locking strip positioned to be inserted within an exemplary sheet locking channel of the exemplary bed sheet retention device.
Figure 9:
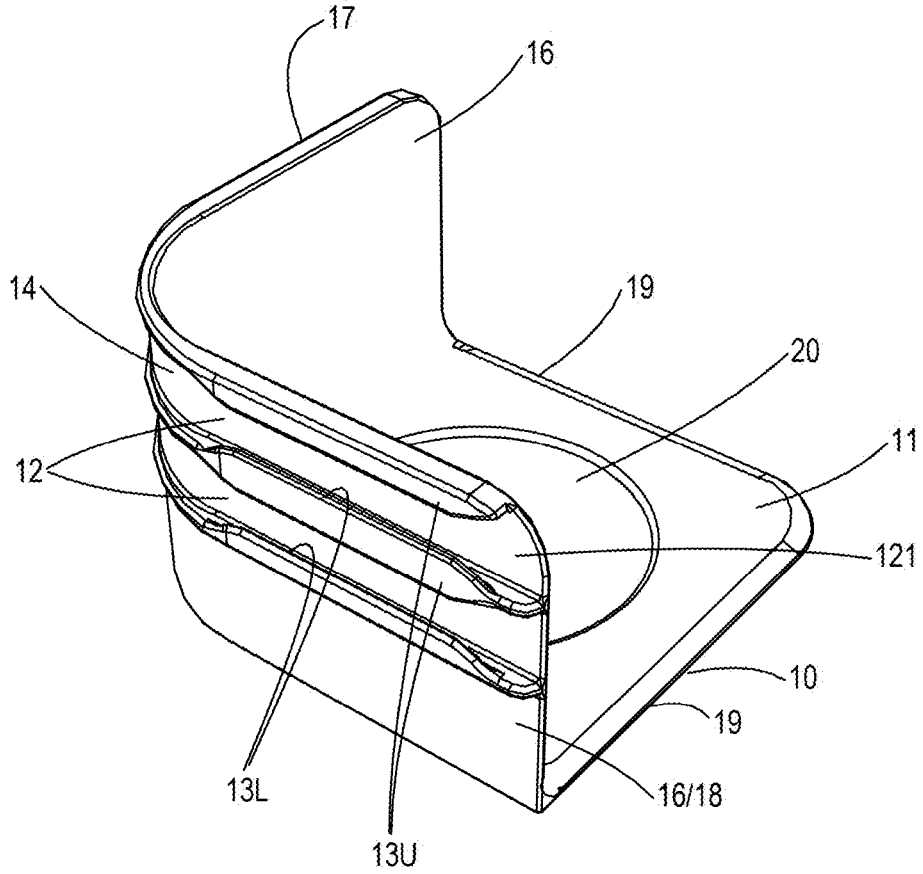
FIG. 9 depicts a perspective view of another exemplary bed sheet retention device suitable for use in the disclosed bed sheet retention systems, the exemplary bed sheet retention device comprising two exemplary sheet locking channels as shown.
Figure 10:
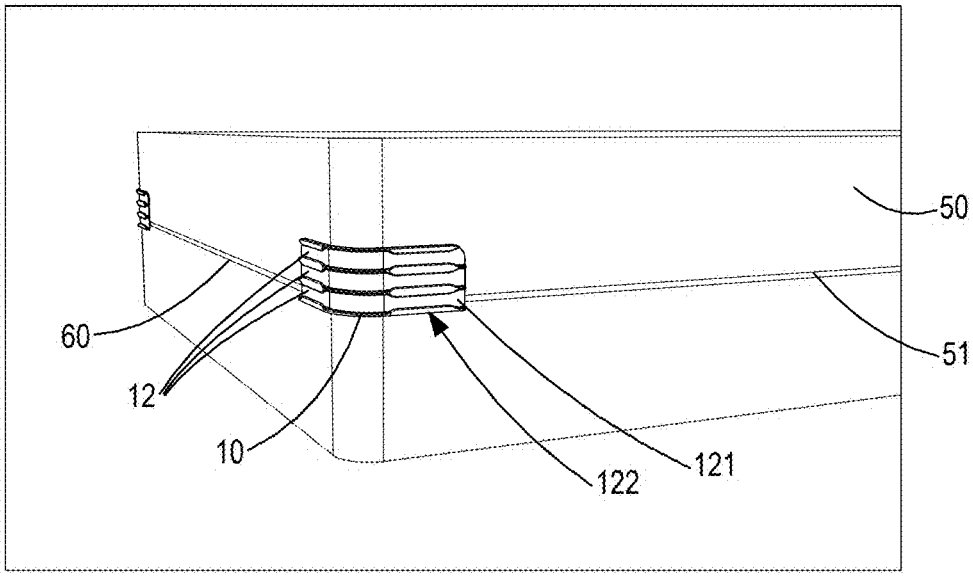
FIG. 10 depicts a perspective view of another exemplary bed sheet retention device suitable for use in the disclosed bed sheet retention systems, the exemplary bed sheet retention device comprising three exemplary sheet locking channels as shown.
Figure 11:
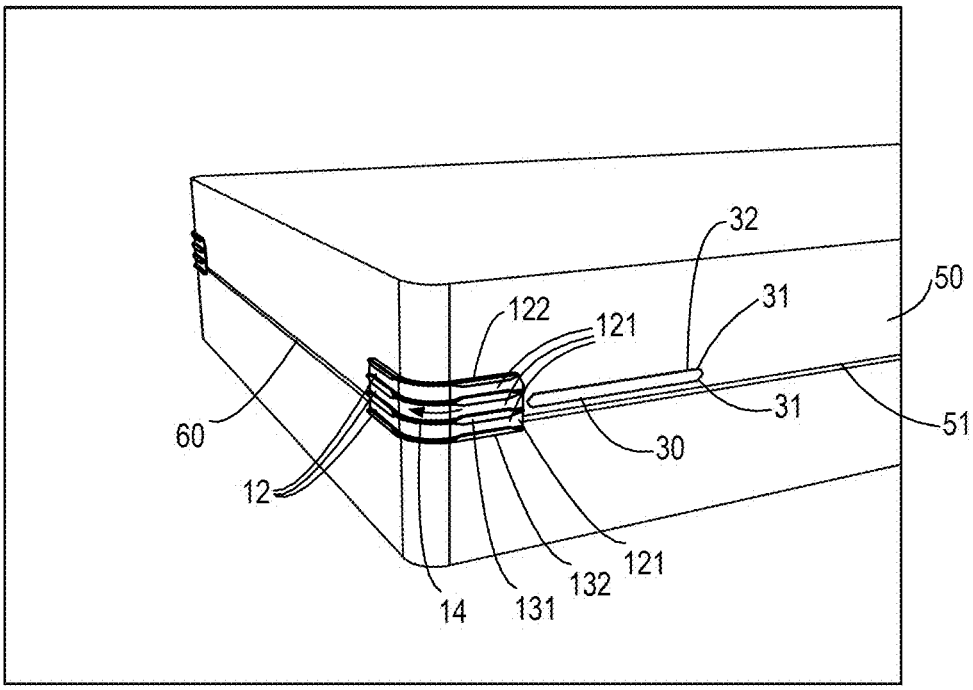
FIG. 11 depicts another perspective view of the exemplary bed sheet retention device shown in FIG. 10 showing a sheet locking strip positioned to be inserted within a central/middle exemplary sheet locking channel of the exemplary bed sheet retention device.
Figure 12:
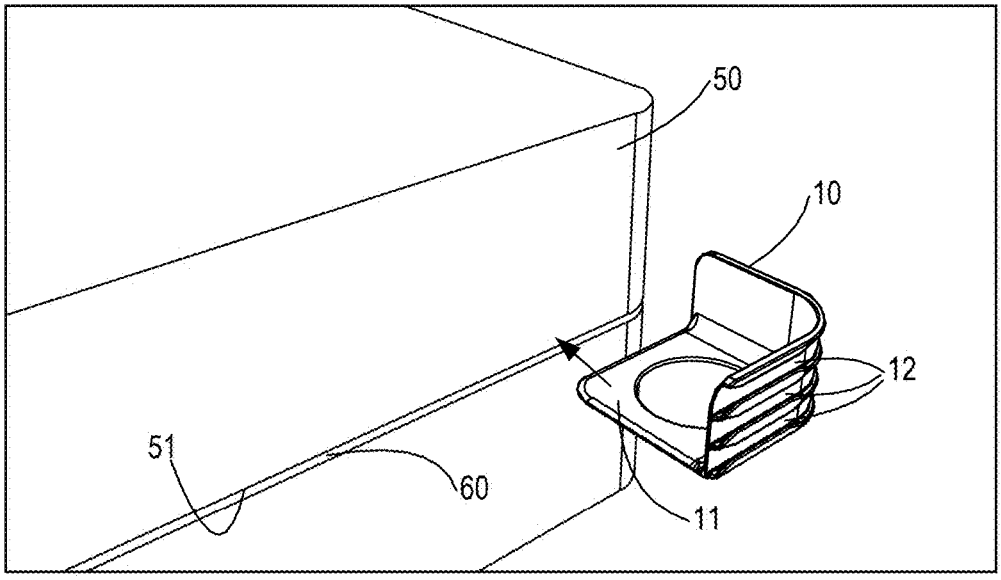
FIG. 12 depicts a perspective view of the exemplary bed sheet retention device shown in FIG. 10 being inserted onto the corner of a mattress.
Figure 13:
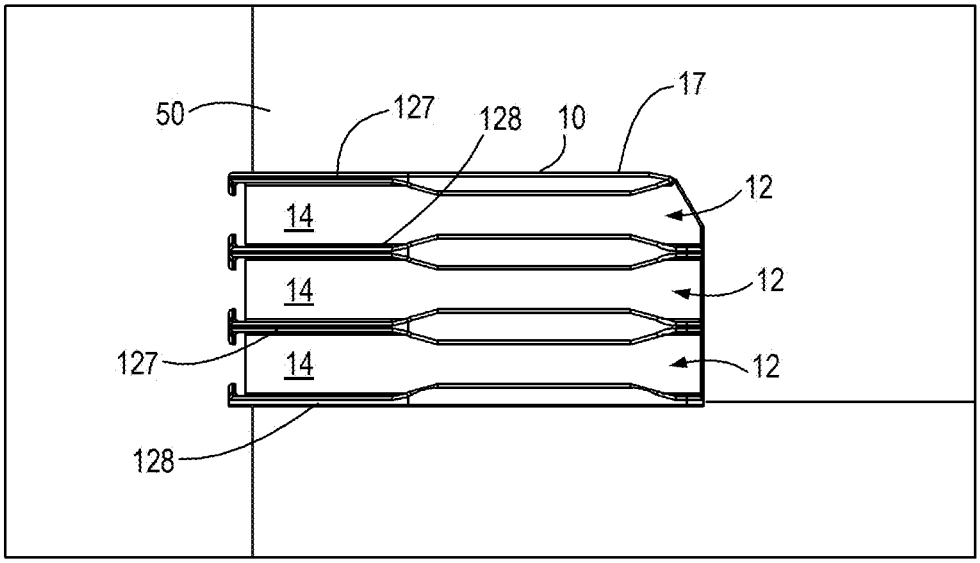
FIG. 13 depicts a front right-side view of the exemplary bed sheet retention device shown in FIG. 10 positioned along corner edges of the mattress shown in FIG. 12.

The features of the present bed sheet retention devices, bed sheet retention system accessories, and bed sheet retention systems, and methods are set forth in part in the following preferred embodiments. This overview is intended to provide nonlimiting descriptions of the present subject matter and is not intended to provide an exclusive or exhaustive explanation. The preferred embodiments below provide further information about the bed sheet retention devices and systems, and methods of the present invention as described herein.

DETAILED DESCRIPTION OF THE INVENTION

The present invention is directed to bed sheet retention devices, bed sheet retention system accessories, and bed sheet retention systems. The bed sheet retention systems and bed sheet retention devices may comprise one or more sheet-connecting members to keep bed sheets fastened to a bed. All of the disclosed designs grip a sheet in a localized individual clamp/connector where the holding forces are directed to each clamp and their teeth/connecting members.

The bed sheet retention devices of the present invention are placed on the corners and/or side edges of a mattress. Depending on the circumstances of the installation, some beds have mattress toppers, thicker and oversized mattresses, as well as smaller and thin mattresses. These circumstances create various scenarios for installing a fitted sheet. Large, oversized mattresses with a mattress topper may use up a great deal of sheeting material, leaving very little to even wrap on the corners and/or sides of the mattress. Then there is the other side of the extreme when the mattress is small, low profile and has an excess of sheeting material. In either scenario, the bed sheet retention devices of the present invention are able to (1) hold down and lock the tight-fitting sheets in place without fear of damaging the material with clamps, and/or (2) take up the excess sheet material and provide a nice snug fit installation.

The bed sheet retention device of the present invention is slid between the mattress and the supporting foundation. This foundation could be a box spring, wood slats, plywood, or other solid foundation that the mattress rests on top of. The bed sheet retention device is inserted so as to be close to the mattress and encompass a mattress corner and/or a a side edge of the mattress.

The user can determine which sheet-engaging channel to use given a particular sheeting/bedding arrangement. The sheet-engaging channel or channels also provide options for relaxed or snug fitted sheets. Using the top track results in less material wrap and looser sheets. The bottom track would be the deepest locking distance to provide the most take-up on the sheet. Once the track is selected, the user will pull the fitted sheet over the corner and/or edge of the mattress as well as a given bed sheet retention device.

For an even lock, the user should be sure that that the sheet material is located in the same channeling. With the sheet material over the bed sheet retention device, the clear plastic lock stripping is then placed onto the channels landing. This landing sets and stages the material for the track and channel grooves ahead. It takes up the necessary material in order for a smooth entry of the locking strip into the flange track.

Once the strip has entered the locking flange area, the material is then captured and the locking strip exits the locking section. In the case of corner brackets, from here the user can take up more material by folding over the excess corner and then wrapping the locking strip over it following the guides rails along the corner and into the secondary locking flange. This captures the bulk of material and placement of the material on the corner. The sheeting is now locked into place and cannot be removed from the mattress unless the clear locking strips are removed.

One of the unique features of the present invention is the ability to not only lock down the fitted sheet, but the user can lock down the flat sheet. This feature provides the added benefit to those who do not like their sheets pulled from the bottom leaving their feet exposed. This keeps the bottom half of the flat sheet captured. The user can control how much tightness is left in the base of the flat sheet by the amount of take-up that was captured on installing the locking strips.

This process is the same as locking down the fitted sheets with the exception that it will be easier to return to the channel where the fitted sheet is locked down to. The channel will then have 2 locking strips and 2 layers of sheeting. Other channels could be used for the flat sheet, but it is observed that reentering the currently used channel, keep the tool from having to get past 2 layers of free moving sheet material. This could result in hang-ups on some occasions.

A shining feature of the present invention is its ability to work in such tight spaces. There is limited access in many mattress scenarios and being able to guide a semirigid stripping into the blond spots of the mattress is a great bonus to this system. The hand held on the corner to guide the strip into the next locking flange area is all that is needed to capture the blind side of the mattress.

The present invention describes various bed sheet retention device styles and ways to lock material down using a similar approach to the above-described sheet-engaging channels and locking strip. These alternative options include the following:

Option A

This type of locking mechanism uses a male track and relies on a female clip to slide over the male track and lock down the material. This method captures the sides of the sheet material, but does not capture the corners of the material in the same manner as the sliding locking strip does. The clips are also more cosmetically noticeable and not as user friendly as above-described sheet-engaging channels and locking strip.

Option B

Another method uses a slit and a soft rubber material which will push the material into the slit and pinch the material along the slit around the corner.

Option C

This method uses a female track and a male pin. The track on the corner bracket is tapered and the pin is straight. The material is pinned by sliding the pin into the track and locking the sides.

Option D

This method uses an aggressive groove that once the elastic falls into, makes removing it difficult.

Option E

A flexible and soft rubber like cord could be used to pin the material into a defined groove and lock the entire corner down by pinching and pushing the fabric into the groove and locked into place by the rubber cord.

Option F

This method uses a flexible material that could snap into a track, like the above-described sheet-engaging channels, instead of sliding a locking strip into the track. This method lacks the rigidity of a solid strip running through the channel. The concept could be very much the same except the locking strip snaps from the front instead of slides in from the side.

Option G

This method uses a cord (e.g., elastic or rigid) that can be fastened to the ends and then the tension of the cord could settle into a predefined groove that it sits in so as to trap the bed sheeting.

The present invention is described above and further illustrated below by way of additional embodiments, and examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

ADDITIONAL EMBODIMENTS

Bed Sheet Retention Device Embodiments

1. A bed sheet retention device 100/200 comprising: (I) a bracket 10/40 comprising: (a) a horizontally-extending bracket component 11 sized and designed to extend between a bottom surface 51 of a mattress 50 and a support surface 60 under the bottom surface 51; and (b) one or more sheet-engaging channels 12 connected to said horizontally-extending bracket component 11, wherein each sheet-engaging channel 12 (1) comprises a sheet-locking member 13 extending along an outer surface 16/46 of the bracket 10/40, and (2) extends substantially within a plane P parallel with said horizontally-extending bracket component 11 or at an angle A to the plane P parallel with said horizontally-extending bracket component 11. In most embodiments, each sheet-engaging channel 12 extends within a plane P parallel with said horizontally-extending bracket component 11; however, in other embodiments, one or more sheet-engaging channels 12 may extend (i) vertically (i.e., 90° to plane P), and/or (ii) at any angle A from 0 degrees (°) to 90° relative to plane P (i.e., +/− any degree between 0° and 90° in increments of) 1.0°.

2. The bed sheet retention device 100/200 of embodiment 1, wherein said bracket 10/40 comprises the corner bracket 10 described herein (i.e., in embodiments 9 to 59 below).

3. The bed sheet retention device 100/200 of embodiment 1, wherein said bracket 10/40 comprises the side bracket 40 described herein (i.e., in embodiments 60 to 105 below).

4. The bed sheet retention device 100/200 of any one of embodiments 1 to 3, wherein each of said one or more sheet-locking members 13 comprises (i) an upper sheet-locking channel member 13U, and (ii) a lower sheet-locking channel member 13L positioned below and spaced from said upper sheet-locking channel member 13U, wherein each of said upper sheet-locking channel member 13U and said lower sheet-locking channel member 13L are designed to engage with one or more sheet locking strips 30 describe herein and/or one or more of the attachable accessories 300 describe herein.

5. The bed sheet retention device 100/200 of any one of embodiments 1 to 4, further comprising: (II) one or more sheet locking strips 30 described herein (e.g., in embodiments 47 to 54 below), each sheet locking strip 30 being sized and designed to engage with said one or more sheet-engaging channels 12 of said bracket 10/40.

6. The bed sheet retention device 100/200 of embodiment 4 or 5, further comprising: (II) one or more sheet locking strips 30 described herein (i.e., in embodiments 47 to 54 below), each sheet locking strip 30 being sized and designed to engage with and be positioned between (i) said upper sheet-locking channel member 13U and (ii) said lower sheet-locking channel member 13L of said bracket 10/40.

7. The bed sheet retention device 100/200 of any one of embodiments 1 to 6, further comprising: (III) one or more accessories 300, wherein each accessory 300 comprises: (a) at least one accessory connecting member 301, and (b) an accessory body 302 connected to and extending from the at least one accessory connecting member 301, wherein the at least one accessory connecting member 301 is configured (i.e., designed) to extend within and connect to the one or more sheet-engaging channels 12 of bracket 10/40. Suitable accessories 300 include, but are not limited to accessories 300 described below in embodiments 106 to 141.

8. The bed sheet retention device 100/200 of any one of embodiments 4 to 6, further comprising: (III) one or more accessories 300, wherein each accessory 300 comprises: (a) at least one accessory connecting member 301, and (b) an accessory body 302 connected to and extending from the at least one accessory connecting member 301, wherein the at least one accessory connecting member 301 is configured (i.e., designed) to engage with and be positioned between (i) said upper sheet-locking channel member 13U and (ii) said lower sheet-locking channel member 13L of said bracket 10/40. Again, suitable accessories 300 include, but are not limited to accessories 300 described below in embodiments 106 to 141.

Corner Bracket Embodiments

9. A bed sheet retention device 100 comprising: (I) a corner bracket 10 comprising: (a) a horizontally-extending bracket component 11 sized and designed to extend between a bottom surface 51 of a mattress 50 and a support surface 60 under the bottom surface 51; and (b) one or more sheet-engaging channels 12 connected to said horizontally-extending bracket component 11, wherein each sheet-engaging channel 12 (1) comprises (a) two sheet-locking members 13*a*/13*b*, and (b) an open guided section 14 extending around a corner 15 of the corner bracket 10, and (2) extends substantially within a plane P parallel with said horizontally-extending bracket component 11 or at an angle A to the plane P parallel with said horizontally-extending bracket component 11. See, for example, exemplary bed sheet retention device 100 shown in FIGS. 1-8, and plane P in FIGS. 2-5.

10. The bed sheet retention device 100 of embodiment 9, wherein each sheet-engaging channel 12 extends substantially within the plane P above said horizontally-extending bracket component 11.

11. The bed sheet retention device 100 of embodiment 9 or 10, wherein said corner bracket 10 further comprises one or more bracket side walls 16 extending from said horizontally-extending bracket component 11 to an upper rim 17 of said corner bracket 10, and each of the one or more sheet-engaging channels 12 is positioned along one or more outer bracket side wall surfaces 18 of said one or more bracket side walls 16.

12. The bed sheet retention device 100 of any one of embodiments 9 to 11, wherein said corner bracket 10 further comprises two bracket side walls 16 extending from said horizontally-extending bracket component 11 to an upper rim 17 of said corner bracket 10, and each of the one or more sheet-engaging channels 10 is positioned along one or more outer bracket side wall surfaces 18 of said two bracket side walls 16.

13. The bed sheet retention device 100 of embodiment 12, wherein said two bracket side walls 16 are connected to one another at the corner 15 of the corner bracket 10.

14. The bed sheet retention device 100 of any one of embodiments 9 to 13, wherein said corner bracket 10 further comprises one continuous bracket side wall 16 extending from said horizontally-extending bracket component 11 to an upper rim 17 of said corner bracket 10, and each of the one or more sheet-engaging channels 12 is positioned along one or more outer bracket side wall surfaces 18 of said one continuous bracket side wall 16. See, for example, exemplary bed sheet retention device 100 shown in FIGS. 1 and 6-13. As shown in FIG. 1, exemplary bed sheet retention device 100 comprises a single, continuous bracket side wall 16 with (1) each of the one or more sheet-engaging channels 12 positioned along opposite substantially straight, perpendicularly-aligned, wall portions, and (2) the open guided section 14 extending along a curved wall portion separating the opposite substantially straight, perpendicularly-aligned, wall portions from one another. See again, FIG. 1.

15. The bed sheet retention device 100 of any one of embodiments 1 to 14, wherein said one or more sheet-engaging channels 12 comprises one to three sheet-engaging channels 12. It should be noted that in some embodiments, each of the one to three sheet-engaging channels 12 may be identical to one another. For example, each of the one to three sheet-engaging channels 12 may have a similar length, height and depth (e.g., a track profile height $L_{TP}$, a track profile height $H_{TP}$, and a track profile width $W_{TP}$) so as to enable a single sheet, two or more sheets, and/or a comforter to be engaged with/connected to a given sheet-engaging channel 12. In other embodiments, when two or more sheet-engaging channels 12 are present, the two or more sheet-engaging channels 12 may differ from one another. For example, in some embodiments, the two or more sheet-engaging channels 12 independently have lengths, heights and depths (e.g., track profile heights $L_{TP}$, track profile heights $H_{TP}$, and track profile widths $W_{TP}$) that differ from one sheet-engaging channel 12 to another sheet-engaging channel 12. In this case, a sheet-engaging channel 12 with larger length, height and depth (e.g., a larger track profile height $L_{TP}$, a larger track profile height $H_{TP}$, and a larger track profile width $W_{TP}$) may be used to engage/connect with a comforter, multiple sheets 70, and/or a larger accessory 300, while a sheet-engaging channel 12 with smaller length, height and depth (e.g., a smaller track profile height $L_{TP}$, a smaller track profile height $H_{TP}$, and a smaller track profile width $W_{TP}$) may be used to engage/connect with a single sheet or two sheets, or a smaller accessory 300, using the same bed sheet retention device 100.

16. The bed sheet retention device 100 of any one of embodiments 1 to 15, wherein said one or more sheet-engaging channels 12 comprises one sheet-engaging channel 12.

17. The bed sheet retention device 100 of any one of embodiments 1 to 15, wherein said one or more sheet-engaging channels 12 comprises two sheet-engaging channels 12.

18. The bed sheet retention device 100 of any one of embodiments 1 to 15, wherein said one or more sheet-engaging channels 12 comprises three sheet-engaging channels 12.

19. The bed sheet retention device 100 of any one of embodiments 1 to 18, wherein said horizontally-extending bracket component 11 comprises an outer bracket periphery 19, and (i) at least one aperture 20 extending through the horizontally-extending bracket component 11 within the outer bracket periphery 19, (ii) a cut-out section (not shown) extending through the horizontally-extending bracket component 11 and forming a portion of the outer bracket periphery 19, or (iii) both (i) and (ii). As shown in FIGS. 2-5, the one or more bracket side walls 16 can also have one or more cut-out sections 21 extending through the one or more bracket side walls 16.

20. The bed sheet retention device 100 of any one of embodiments 1 to 19, wherein said horizontally-extending bracket component 11 comprises an outer bracket periphery 19, and at least one aperture 20 extending through the horizontally-extending bracket component 11 within the outer bracket periphery 19.

21. The bed sheet retention device 100 of any one of embodiments 1 to 20, wherein said horizontally-extending bracket component 11 comprises an outer bracket periphery 19, and a single aperture 20 extending through the horizontally-extending bracket component 11 within the outer bracket periphery 19.

22. The bed sheet retention device 100 of any one of embodiments 11 to 21, wherein said horizontally-extending bracket component 11, said one or more bracket side walls 16, and said one or more sheet-engaging channels 12 are integrally connected to one another.

23. The bed sheet retention device 100 of any one of embodiments 11 to 22, wherein said one or more sheet-engaging channels 12 are positioned along said upper rim 17 of said corner bracket 10.

24. The bed sheet retention device 100 of any one of embodiments 9 to 23, wherein said two sheet-locking members **13*a*/13*b* comprise (i) a first sheet-engaging channel 13*a* extending in a first direction de along said corner bracket 10, and (ii) a second sheet-engaging channel 13*b* extending in a second direction $d_S$ along said corner bracket 10, said second direction $d_S$ being substantially perpendicular to and in plane P with said first direction $d_F$. See, for example, FIG. 6**.

Figure 15:
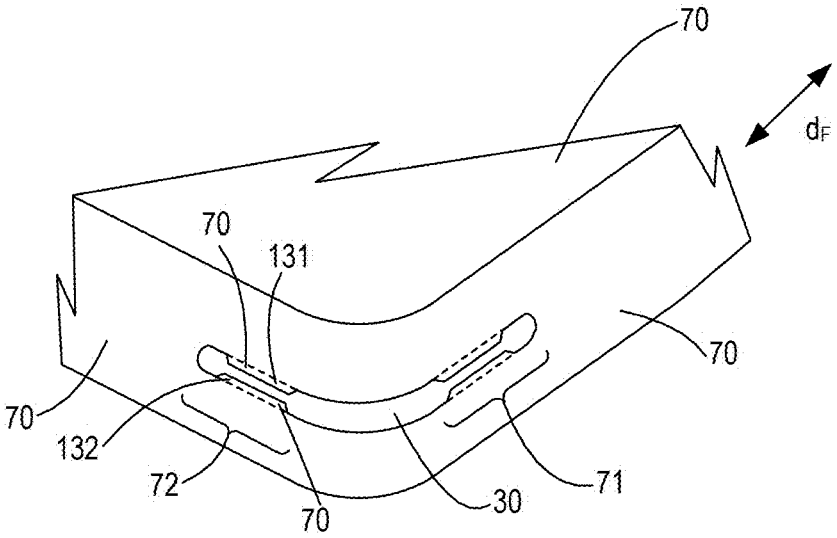
FIG. 15 depicts a side profile view of a sheet locked within an exemplary sheet locking channel of the exemplary bed sheet retention device shown in FIG. 1, 9, or 10 using a sheet locking strip positioned within the exemplary sheet locking channel and over corner portions of the sheet.

25. The bed sheet retention device 100 of embodiment 24, wherein when said horizontally-extending bracket component 11 is positioned between a bottom surface 51 of a mattress 50 and a support surface 60 under the bottom surface 51, the first sheet-engaging channel **13*a* is positioned to be engageable with a first portion 71 of a sheet 70 extending along the first direction de, and the second sheet-engaging channel 13*b* is positioned to be engageable with a second portion 72 of the sheet 70 extending along the second direction $d_S$. See, for example, FIG. 15**.

26. The bed sheet retention device 100 of any one of embodiments 9 to 25, wherein said two sheet-locking members **13*a*/13*b* (1) comprise (i) a first sheet-engaging channel 13*a* extending in a first direction de along said corner bracket 10, and (ii) a second sheet-engaging channel 13*b* extending in a second direction $d_S$ along said corner bracket 10, said second direction $d_S$ being substantially perpendicular to and in plane P with said first direction de, and (2) each of said first sheet-engaging channel 13*a* and said second sheet-engaging channel 13*b* independently comprises (i) an upper sheet-locking channel member 13U, and a lower sheet-locking channel member 13L positioned below and spaced from said upper sheet-locking channel member 13U. See, for example, FIGS. 1-3, and 8-9**.

27. The bed sheet retention device 100 of embodiment 26, wherein each of said upper sheet-locking channel member 13U and said lower sheet-locking channel member 13L are designed to engage with one or more sheet locking strips 30, one or more sheet locking pins (not shown), or both.

28. The bed sheet retention device 100 of embodiment 26 or 27, wherein each of said upper sheet-locking channel member 13U and said lower sheet-locking channel member 13L are designed to engage with a single sheet locking strip 30.

29. The bed sheet retention device 100 of any one of embodiments 26 to 28, wherein said upper sheet-locking channel member 13U comprises an upper strip engaging member 131 extending towards said lower sheet-locking channel member 13L, and said lower sheet-locking channel member 13L comprises a lower strip engaging member 132 extending towards said upper sheet-locking channel member 13U. See, for example, FIGS. 2, and 4.

30. The bed sheet retention device 100 of embodiment 29, wherein said upper strip engaging member 131 is separated from said lower strip engaging member 132 by a strip engaging member separation distance $d_{SM}$ that is less than a strip width $W_S$ of a sheet locking strip 30. See, for example, FIGS. 3, and 8.

31. The bed sheet retention device 100 of embodiment 30, wherein said strip engaging member separation distance $d_{SM}$ is greater at a strip inlet 121 of a given sheet-engaging channel 12 (e.g., at an outer entry point 121 at which a locking strip 30 is engaged with said upper strip engaging member 131 and said lower strip engaging member 132 along the corner bracket 10; see, for example, FIG. 2) than at a midpoint 122 along a given sheet-engaging channel (e.g., at a midpoint 122 along said upper strip engaging member 131 and said lower strip engaging member 132 along the corner bracket 10; see, for example, FIGS. 2, and 10-11).

32. The bed sheet retention device 100 of embodiment 30 or 31, wherein said strip engaging member separation distance $d_{SM}$ decreases from a maximum separation distance $d_{SMM}$ at a strip inlet 121 of a given sheet-engaging channel 12 (e.g., at an outer entry point 121 at which a locking strip 30 is engaged with said upper strip engaging member 131 and said lower strip engaging member 132 along the corner bracket 10; see, for example, FIG. 8) to a minimum separation distance $d_{SMN}$ at a location or length 124 along the given sheet-engaging channel 12 (e.g., at a midpoint or midpoint length 124 along said upper strip engaging member 131 and said lower strip engaging member 132 along the corner bracket 10; see, for example, FIG. 2).

33. The bed sheet retention device 100 of embodiment 32, wherein said strip engaging member separation distance $d_{SM}$ increases from the minimum separation distance $d_{SMN}$ at the location or the length 124 along the given sheet-engaging channel 12 to an exit separation distance $d_{SME}$ at a strip outlet 125 of the given sheet-engaging channel 12, said exit separation distance $d_{SME}$ being greater than said minimum separation distance $d_{SMM}$. See, for example, FIG. 2.

34. The bed sheet retention device 100 of any one of embodiments 11 to 32, wherein each sheet-engaging channel 12' of said one or more sheet-engaging channels 12 further comprises channel side walls 127/128 extending (1) outward from said one or more bracket side walls 16, and (2) along lower and upper edges 137/138 of (a) said two sheet-locking members 13*a*/13*b*, and (b) said open guided section 14. See, for example, FIGS. 2 and 5.

35. The bed sheet retention device 100 of embodiment 34, wherein said upper strip engaging member 131 and said lower strip engaging member 132 extend from said channel side walls 127/128 towards one another. See again, FIG. 2.

36. The bed sheet retention device 100 of any one of embodiments 9 to 35, wherein said corner bracket 10 has a bracket length $L_B$ of from about 3.0 inches (in) to about 16.0 in (or any value between 3.0 in and 16.0 in, in increments of 0.1 in, e.g., 8.2 in, or any range of values between 3.0 in and 16.0 in, in increments of 0.1 in, e.g., from 6.6 in to 11.2 in), a bracket width $W_B$ of from about 3.0 in to about 16.0 in (or any value between 3.0 in and 16.0 in, in increments of 0.1 in, e.g., 9.3 in, or any range of values between 6.0 in and 16.0 in, in increments of 0.1 in, e.g., from 6.8 in to 10.2 in), and a bracket height $H_B$ of from about 1.5 in to about 12.0 in (or any value between 1.5 in and 12.0 in, in increments of 0.1 in, e.g., 8.7 in, or any range of values between 1.5 in and 12.0 in, in increments of 0.1 in, e.g., from 5.6 in to 8.8 in). See, for example, FIGS. 5 and 7. It should be understood that each corner bracket 10 may have any desired bracket length $L_B$, and any desired bracket width $W_B$.

37. The bed sheet retention device 100 of any one of embodiments 9 to 36, wherein said corner bracket 10 has a bracket length $L_B$ of from about 6.0 inches (in) to about 9.0 in, a bracket width $W_B$ of from about 6.0 in to about 9.0 in, and a bracket height $H_B$ of from about 3.0 in to about 6.0 in.

38. The bed sheet retention device 100 of any one of embodiments 9 to 37, wherein said corner bracket 10 has a bracket length $L_B$ of about 8.5 in, a bracket width $W_B$ of about 8.5 in, and a bracket height $H_B$ of about 4.3 in.

Figure 14:
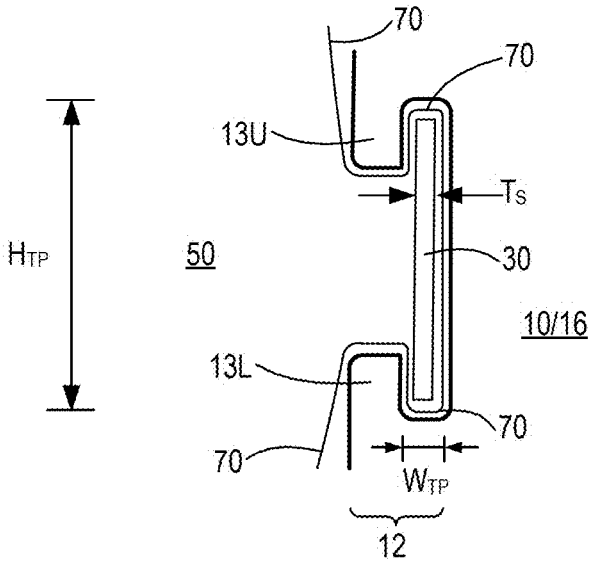
FIG. 14 depicts a side profile view of a sheet locked within an exemplary sheet locking channel of the exemplary bed sheet retention device shown in FIG. 1, 9, or 10 showing a sheet locking strip positioned to be inserted within an upper exemplary sheet locking channel of the exemplary bed sheet retention device.
Figure 18A:
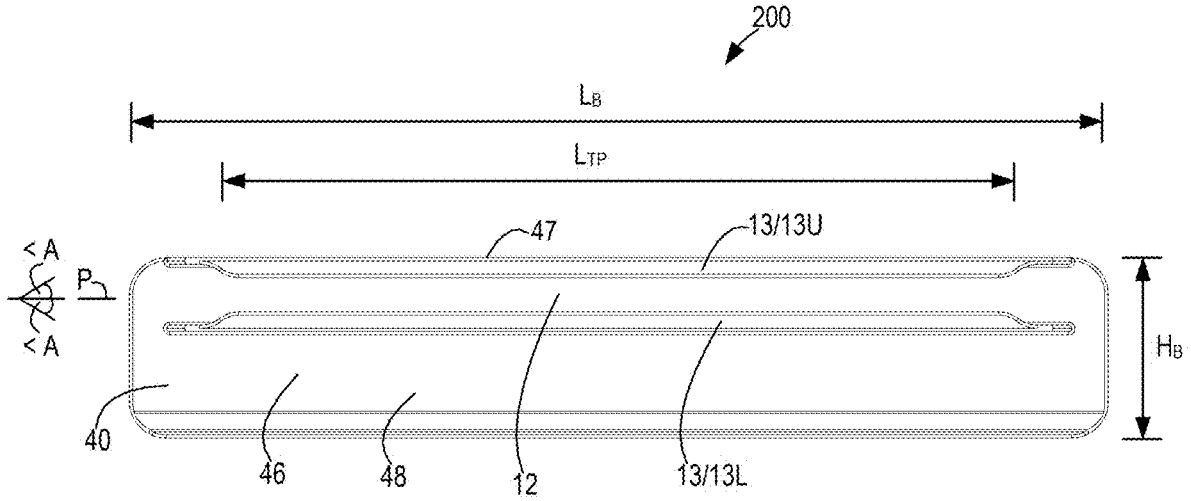
FIG. 18A depicts a front view of the exemplary bed sheet retention device shown in FIG. 16.

39. The bed sheet retention device 100 of any one of embodiments 1 to 38, wherein each of said one or more sheet-engaging channels 12 comprises a track profile having (i) a track profile length $L_{TP}$ of from about 2.5 inches (in) to about 15.5 in (or any value between 2.5 in and 15.5 in, in increments of 0.1 in, e.g., 8.2 in, or any range of values between 2.5 in and 15.5 in, in increments of 0.1 in, e.g., from 4.6 in to 7.2 in), (ii) a track profile height $H_{TP}$ of from about 0.6 in to about 3.0 in (or any value between 0.6 in and 3.0 in, in increments of 0.01 in, e.g., 0.75 in, or any range of values between 0.6 in and 3.0 in, in increments of 0.01 in, e.g., from 0.89 in to 1.65 in), and (iii) a track profile width $W_{TP}$ of from about 0.1 in to about 1.5 in (or any value between 0.1 in and 1.5 in, in increments of 0.01 in, e.g., 0.15 in, or any range of values between 0.1 in and 1.5 in, in increments of 0.01 in, e.g., from 0.16 in to 0.87 in). See, for example, FIG. 14. It should be understood that each of said one or more sheet-engaging channels 12 may independently have a track profile having any desired track profile length $L_{TP}$, any desired track profile height $H_{TP}$, and any desired track profile width $W_{TP}$. As used herein, the term track profile length $L_{TP}$ refers to (a) a track profile length of a single sheet-engaging channel 12, such as shown in exemplary side bracket 40 in FIG. 18A, or (b) a track profile length of the sheet-engaging channels 12 within sheet-locking member 13*a* and sheet-locking member 13*b*, such as shown in exemplary corner bracket 10 in FIG. 1.

40. The bed sheet retention device 100 of any one of embodiments 1 to 39, wherein each of said one or more sheet-engaging channels 12 comprises a track profile having (i) a track profile length $L_{TP}$ of from about 3.0 in to about 8.0 in, (ii) a track profile height $H_{TP}$ of about 1.1875 in, and (iii) a track profile width $W_{TP}$ of about 0.1875 in.

41. The bed sheet retention device 100 of any one of embodiments 9 to 40, wherein said corner bracket 10 comprises a polymeric material.

42. The bed sheet retention device 100 of any one of embodiments 9 to 41, wherein said corner bracket 10 comprises a fiber and/or powder/particle filled polymeric material.

43. The bed sheet retention device 100 of embodiment 41 or 42, wherein said polymeric material comprises a polyolefin, an acrylonitrile butadiene styrene copolymer (i.e., an ABS copolymer), a polycarbonate, a polyester, or any combination thereof.

44. The bed sheet retention device 100 of any one of embodiments 41 to 43, wherein said polymeric material comprises a polyolefin, an acrylonitrile butadiene styrene copolymer (i.e., an ABS copolymer), or a combination thereof.

45. The bed sheet retention device 100 of any one of embodiments 41 to 44, wherein said polymeric material comprises an acrylonitrile butadiene styrene copolymer (i.e., an ABS copolymer).

46. The bed sheet retention device 100 of any one of embodiments 42 to 45, wherein said polymeric material is filled with glass fibers and/or glass powder/particles.

47. The bed sheet retention device 100 of any one of embodiments 9 to 46, further comprising: (II) one or more sheet locking strips 30, each sheet locking strip 30 being sized and designed to engage with said one or more sheet-engaging channels 12 of said corner bracket 10. It should be understood that each of the one or more sheet locking strips 30 may independently provide one or more additional features to the bed sheet retention device 100. For example, one or more sheet locking strip 30 may be scented so as to provide a scent into the environment surrounding the bed sheet retention device 100. Other sheet locking strips 30 may be luminescent so as to provide light into the environment surrounding the bed sheet retention device 100. Other sheet locking strips 30 could have an attachment material (e.g., hook/loop material, magnet, adhesive, etc.) along an outer surface to attached objects to the sheet locking strip 30.

48. The bed sheet retention device 100 of any one of embodiments 9 to 47, further comprising: (II) a single sheet locking strip 30 sized and designed to engage with any one sheet-engaging channel 12 within said one or more sheet-engaging channels 12 of said corner bracket 10.

49. The bed sheet retention device 100 of embodiment 47 or 48, wherein each sheet locking strip 30 has a strip width $W_S$ of from about 0.5 in to about 1.5 in, and a strip thickness $T_S$ of from about 0.05 in to about 0.10 in, and a strip length $L_S$ of from about 4.0 in to about 18.0 in.

50. The bed sheet retention device 100 of any one of embodiments 47 to 49, wherein each sheet locking strip 30 has a strip width $W_S$ of from about 0.8 in to about 1.2 in, and a strip thickness $T_S$ of from about 0.05 in to about 0.08 in, and a strip length $L_S$ of from about 12.0 in to about 16.0 in.

51. The bed sheet retention device 100 of any one of embodiments 47 to 50, wherein each sheet locking strip 30 has a strip width $W_S$ of about 1.0 in, and a strip thickness $T_S$ of about 0.0625 in, and a strip length $L_S$ of about 15.5 in.

52. The bed sheet retention device 100 of any one of embodiments 47 to 51, wherein each sheet locking strip 30 has (1) a 0.5 in radius on each strip corner 31 to make each strip end 32 round, and (2) strip edges 33 that are radiused at about 0.03125 in to provide a smooth finish without corners or edges.

53. The bed sheet retention device 100 of any one of embodiments 47 to 52, wherein each sheet locking strip 30 comprises an acrylic material or a polycarbonate material.

54. The bed sheet retention device 100 of any one of embodiments 47 to 53, wherein each sheet locking strip 30 comprises an acrylic material.

55. A bed sheet retention device 100 comprising: (I) a corner bracket 10 comprising: (a) a horizontally-extending bracket component 11 sized and designed to extend between a bottom surface 51 of a mattress 50 and a support surface 60 under the bottom surface 51; and (b) two or more sheet-engaging channels 12 connected to said horizontally-extending bracket component 11, said two or more sheet-engaging channels 12 (1) being separated from one another by a corner 15 of the corner bracket 10, (2) extending substantially within a plane P parallel with said horizontally-extending bracket component 11, and (3) each independently comprising (i) an upper sheet-locking channel member 13U, and (ii) a lower sheet-locking channel member 13L positioned below and spaced from said upper sheet-locking channel member 13U, wherein each of said upper sheet-locking channel member 13U and said lower sheet-locking channel member 13L are designed to engage with one or more sheet locking strips 30 describe herein and/or one or more of the herein-described attachable accessories 300 describe herein See, for example, exemplary bed sheet retention device 100 shown in FIGS. 1-8, and plane P in FIGS. 2-5.

56. The bed sheet retention device 100 of embodiment 55, wherein said two or more sheet-engaging channels 12 comprises (a) two sheet-locking members 13*a*/13*b*.

57. The bed sheet retention device 100 of embodiment 56, wherein said two sheet-locking members 13*a*/13*b* are separated from one another by (b) an open guided section 14 extending around the corner 15 of the corner bracket 10.

58. The bed sheet retention device 100 of embodiment 57, wherein said bed sheet retention device 100 comprises one or more features recited in any one of embodiments 1 to 54.

59. The bed sheet retention device 100 of any one of embodiments 9 to 58, further comprising: (III) one or more accessories 300, wherein each accessory 300 comprises: (a) at least one accessory connecting member 301, and (b) an accessory body 302 connected to and extending from the at least one accessory connecting member 301, wherein the at least one accessory connecting member 301 is configured (i.e., designed) to extend within and connect to the one or more sheet-engaging channels 12 of corner bracket 40.

Side Bracket Embodiments

Figure 18B:
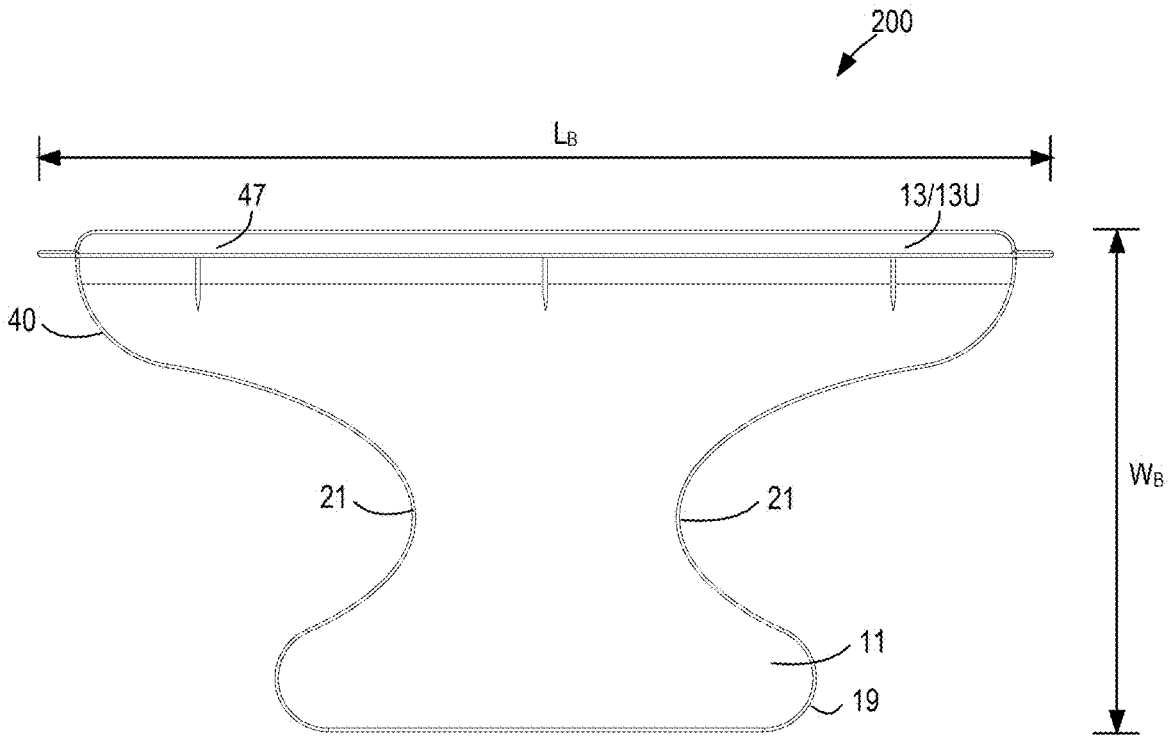
FIG. 18B depicts a top view of the exemplary bed sheet retention device shown in FIG. 16.
Figure 18C:
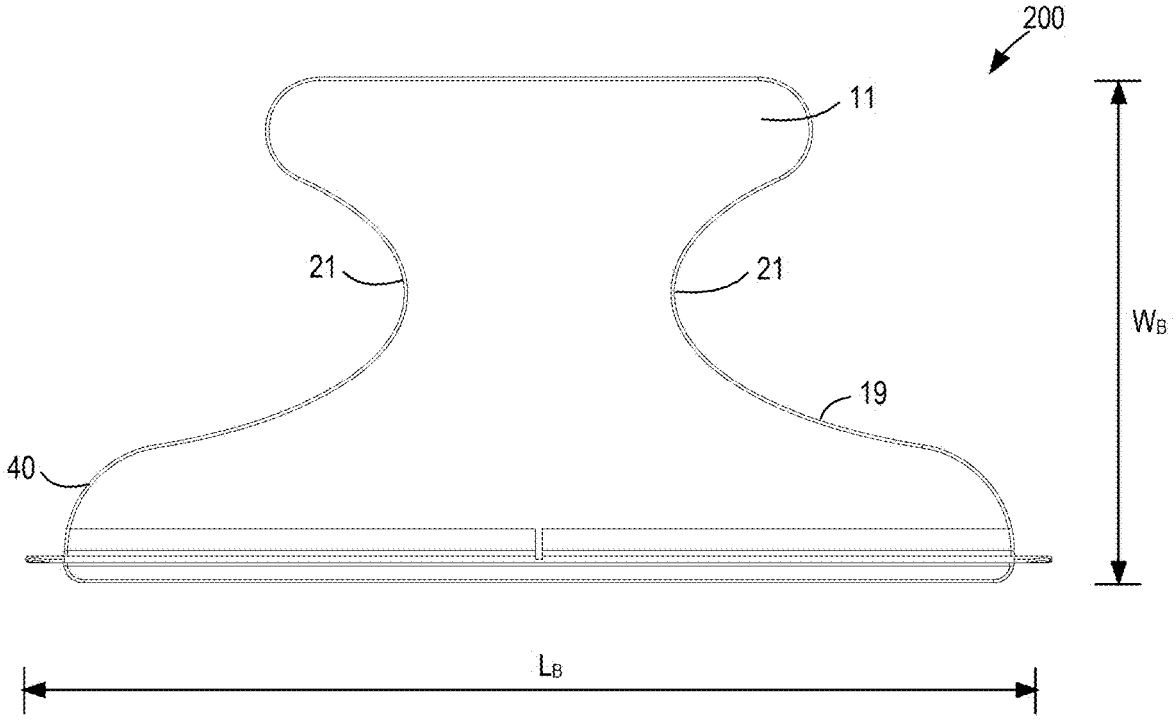
FIG. 18C depicts a bottom view of the exemplary bed sheet retention device shown in FIG. 16.
Figure 19:
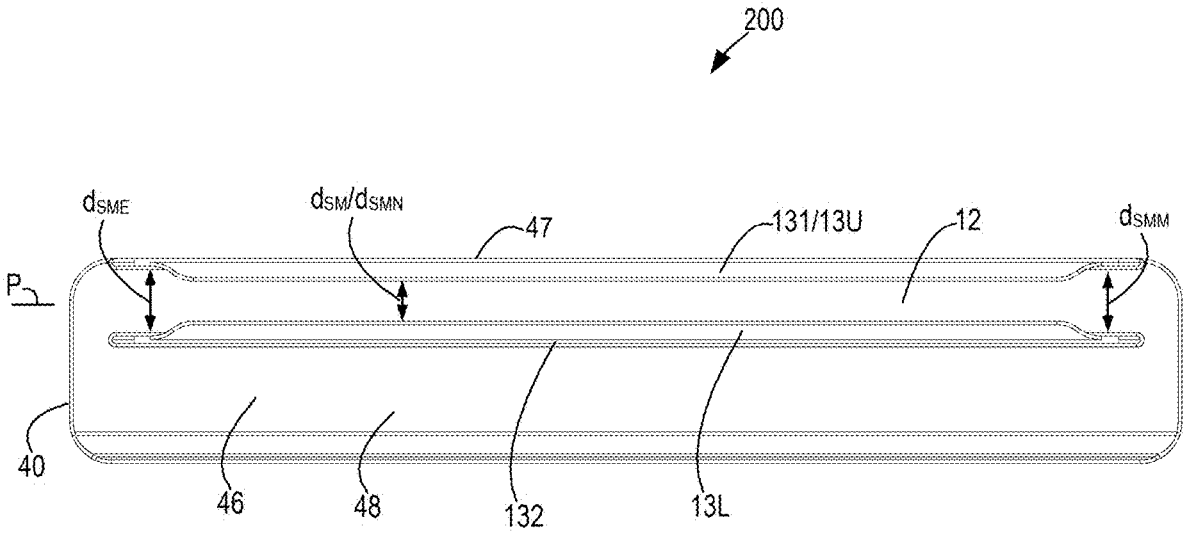
FIG. 19 depicts another front view of the exemplary bed sheet retention device shown in FIG. 1.
Figure 20:
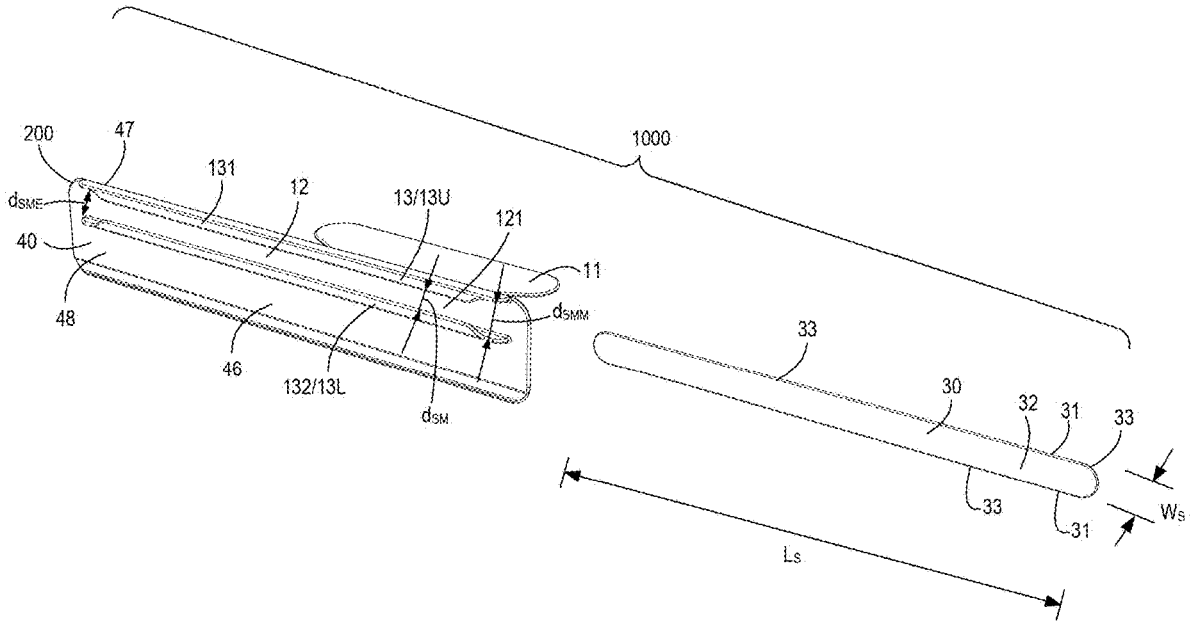
FIG. 20 depicts another perspective view of the exemplary bed sheet retention device shown in FIG. 16 showing a sheet locking strip positioned to be inserted within an exemplary sheet locking channel of the exemplary bed sheet retention device.
Figure 21:
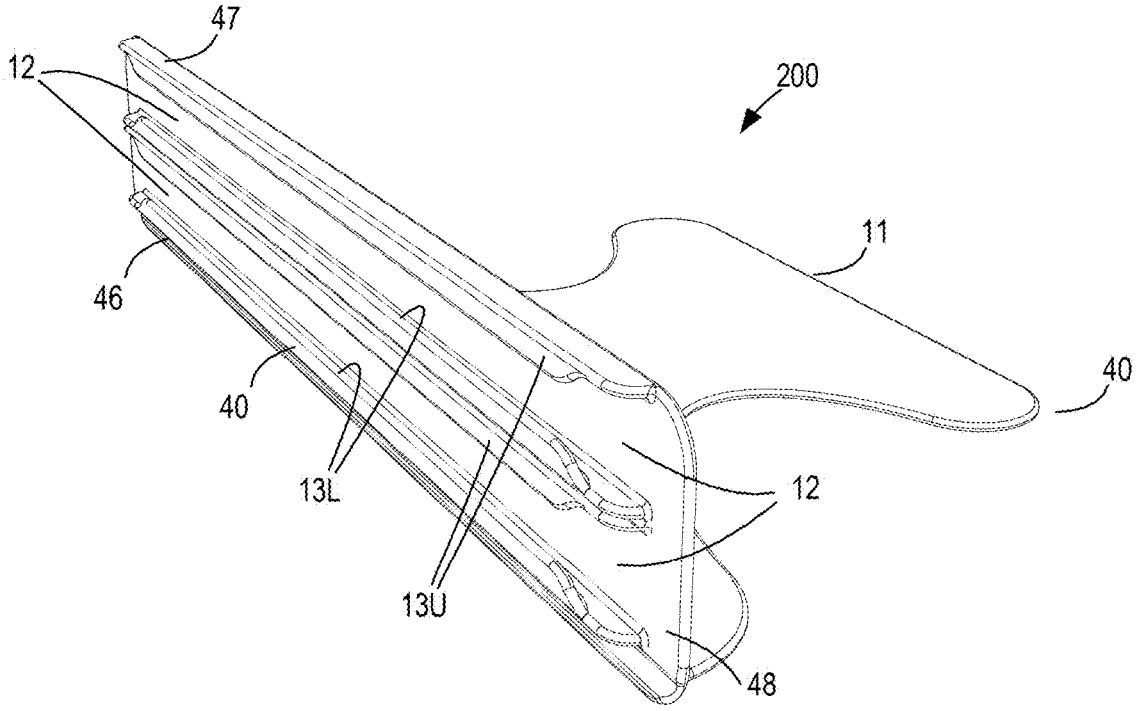
FIG. 21 depicts a perspective front view of another exemplary bed sheet retention device suitable for use in the disclosed bed sheet retention systems, the exemplary bed sheet retention device comprising two exemplary sheet locking channels as shown.
Figure 22:
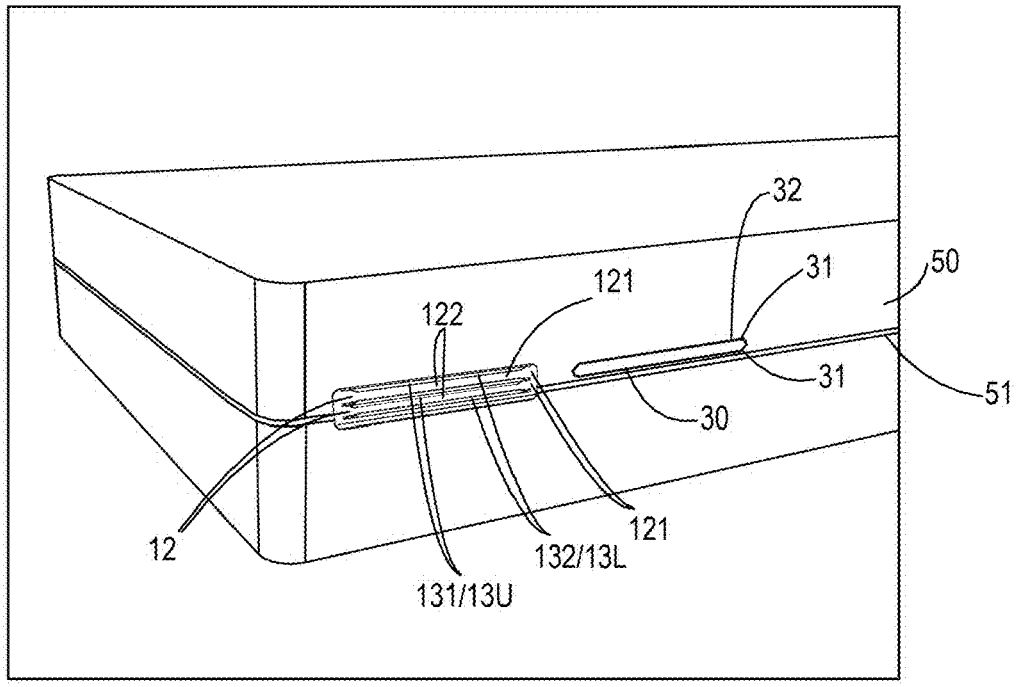
FIG. 22 depicts a perspective view of another exemplary bed sheet retention device suitable for use in the disclosed bed sheet retention systems, the exemplary bed sheet retention device comprising three exemplary sheet locking channels as shown, and being inserted along a side surface of a mattress.
Figure 23:
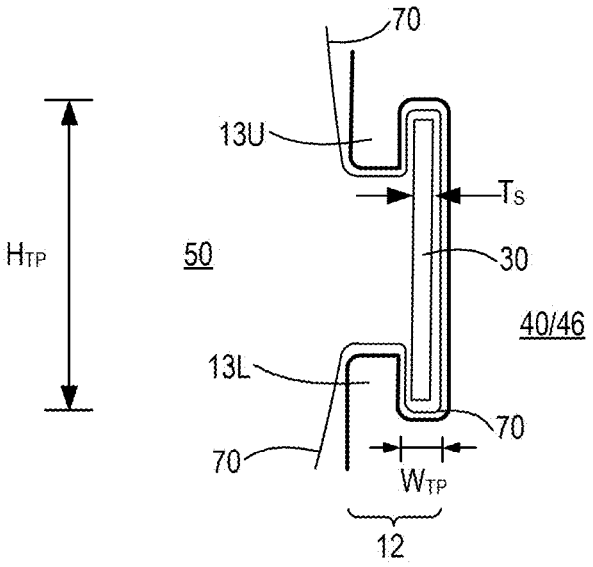
FIG. 23 depicts a side profile view of a sheet locked within an exemplary sheet locking channel of the exemplary bed sheet retention device shown in FIG. 16, or 18-22 showing a sheet locking strip positioned to be inserted within an upper exemplary sheet locking channel of the exemplary bed sheet retention device.
Figure 24:
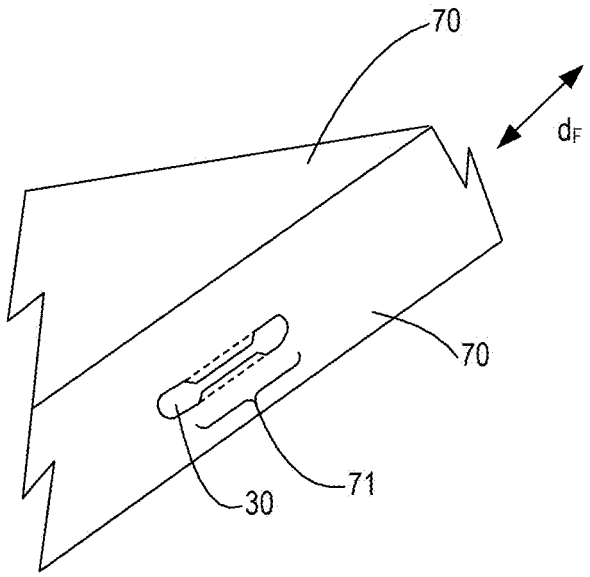
FIG. 24 depicts a side profile view of a sheet locked within an exemplary sheet locking channel of the exemplary bed sheet retention device shown in FIG. 16, or 18-22 using a sheet locking strip positioned within the exemplary sheet locking channel and over side portions of the sheet.

60. A bed sheet retention device 200 comprising: (I) a side bracket 40 comprising: (a) a horizontally-extending bracket component 11 sized and designed to extend between a bottom surface 51 of a mattress 50 and a support surface 60 under the bottom surface 51; and (b) one or more sheet-engaging channels 12 connected to said horizontally-extending bracket component 11, wherein each sheet-engaging channel 12 (1) comprises a sheet-locking member 13 extending along an outer surface 46 of the side bracket 40, and (2) extends (i) substantially within a plane P parallel with said horizontally-extending bracket component 11 or at an angle A to the plane P parallel with said horizontally-extending bracket component 11, and (ii) along a side edge (i.e., not a corner) of the mattress 50 and the support surface 60. See, for example, exemplary bed sheet retention device 100 shown in FIGS. 16-24, and plane P in FIG. 18.

61. The bed sheet retention device 200 of embodiment 60, wherein each sheet-engaging channel 12 extends substantially within the plane P above said horizontally-extending bracket component 11.

62. The bed sheet retention device 200 of embodiment 60 or 61, wherein said side bracket 40 further comprises one or more bracket side walls 46 extending from said horizontally-extending bracket component 11 to an upper rim 47 of said side bracket 40, and each of the one or more sheet-engaging channels 12 is positioned along one or more outer bracket side wall surfaces 48 of said one or more bracket side walls 46.

63. The bed sheet retention device 200 of any one of embodiments 60 to 62, wherein said side bracket 40 further comprises a single bracket side wall 46 extending from said horizontally-extending bracket component 11 to an upper rim 47 of said side bracket 40, and each of the one or more sheet-engaging channels 12 is positioned along one or more outer bracket side wall surfaces 48 of said single bracket side wall 46.

Figure 16:
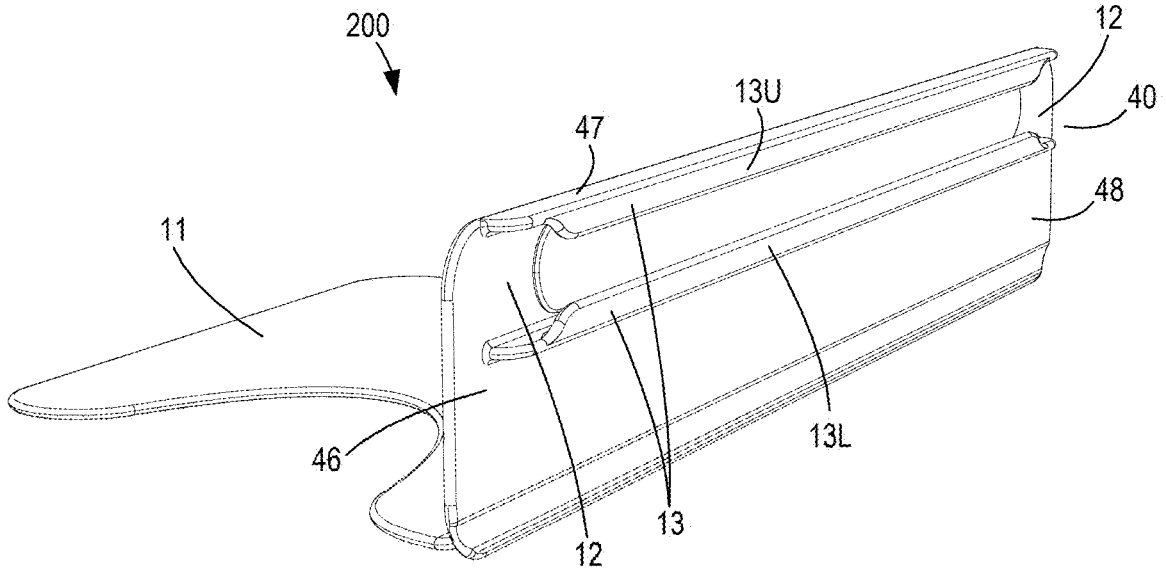
FIG. 16 depicts a perspective front view of another exemplary bed sheet retention device suitable for use in the disclosed bed sheet retention systems.
Figure 17:
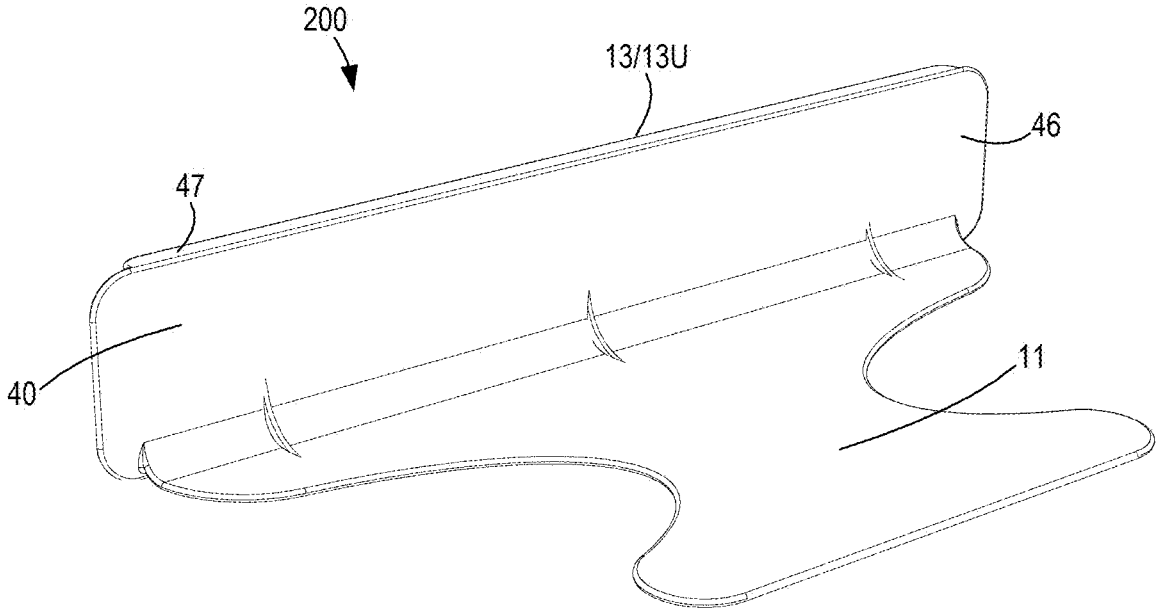
FIG. 17 depicts a perspective rear view of the exemplary bed sheet retention device shown in FIG. 16.

64. The bed sheet retention device 200 of any one of embodiments 60 to 63, wherein said side bracket 40 comprises one continuous bracket side wall 46 extending from said horizontally-extending bracket component 11 to an upper rim 47 of said side bracket 40, and each of the one or more sheet-engaging channels 12 is positioned along one or more outer bracket side wall surfaces 48 of said one continuous bracket side wall 46. See, for example, exemplary bed sheet retention device 200 shown in FIGS. 16-24. As shown in FIG. 16, exemplary bed sheet retention device 200/exemplary side bracket 40 comprises a single, continuous bracket side wall 46 with (1) a single sheet-engaging channel 12 positioned along an upper portion of outer bracket side wall surface 48 of said single, continuous bracket side wall 46. It should be noted that although bracket side walls 46 (and bracket side walls 16) are shown as continuous side walls, one or more of bracket side walls 46 (and/or bracket side walls 16) could have one or more apertures (not shown) extending through a given bracket side wall 46 (or bracket side wall 16).

65. The bed sheet retention device 200 of any one of embodiments 60 to 64, wherein said one or more sheet-engaging channels 12 comprises one to three sheet-engaging channels 12. See, for example, bed sheet retention devices 200 shown in FIG. 16-24, It should be noted that in some embodiments, each of the one to three sheet-engaging channels 12 may be identical to one another. For example, each of the one to three sheet-engaging channels 12 may have a similar length, height and depth (e.g., a track profile height $L_{TP}$, a track profile height $H_{TP}$, and a track profile width $W_{TP}$) so as to enable a single sheet, two or more sheets, and/or a comforter to be engaged with/connected to a given sheet-engaging channel 12. In other embodiments, when two or more sheet-engaging channels 12 are present, the two or more sheet-engaging channels 12 may differ from one another. For example, in some embodiments, the two or more sheet-engaging channels 12 independently have lengths, heights and depths (e.g., track profile heights $L_{TP}$, track profile heights $H_{TP}$, and track profile widths $W_{TP}$) that differ from one sheet-engaging channel 12 to another sheet-engaging channel 12. In this case, a sheet-engaging channel 12 with larger length, height and depth (e.g., a larger track profile height $L_{TP}$, a larger track profile height $H_{TP}$, and a larger track profile width $W_{TP}$) may be used to engage/connect with a comforter, multiple sheets 70, and/or a larger accessory 300, while a sheet-engaging channel 12 with smaller length, height and depth (e.g., a smaller track profile height $L_{TP}$, a smaller track profile height $H_{TP}$, and a smaller track profile width $W_{TP}$) may be used to engage/connect with a single sheet or two sheets, or a smaller accessory 300, using the same bed sheet retention device 200.

66. The bed sheet retention device 200 of any one of embodiments 60 to 65, wherein said one or more sheet-engaging channels 12 comprises one sheet-engaging channel 12.

67. The bed sheet retention device 200 of any one of embodiments 60 to 65, wherein said one or more sheet-engaging channels 12 comprises two sheet-engaging channels 12.

68. The bed sheet retention device 200 of any one of embodiments 60 to 65, wherein said one or more sheet-engaging channels 12 comprises three sheet-engaging channels 12.

69. The bed sheet retention device 200 of any one of embodiments 60 to 68, wherein said horizontally-extending bracket component 11 comprises an outer bracket periphery 19, and optionally (i) at least one aperture (not shown) extending through the horizontally-extending bracket component 11 within the outer bracket periphery 19, or (ii) at least one cut-out section 21 extending along and forming a portion of the outer bracket periphery 19, or (iii) both (i) and (ii). Although not shown, the one or more bracket side walls 46 can also have one or more apertures (not shown) and/or cut-out sections 21 extending through the one or more bracket side walls 46. It should be understood that although exemplary horizontally-extending bracket component 11. shown in FIGS. 16-24 has an hour-glass shape, exemplary horizontally-extending bracket component 11 may have any shape as long as the shape provides a desired amount of structural integrity for a particular purpose (e.g., locking one or more sheets 70 in place, supporting one or more accessories 300, or both). For example, exemplary horizontally-extending bracket component 11 could have an overall square or rectangular shape, or a triangular or I-shape, or any other shape. It should also be understood that horizontally-extending bracket component 11 may further comprise one or more features including, but not limited to, (i) an anti-slip coating or layer (not shown) (e.g., a rubber coating or layer) along at least a portion of the lower surface of the horizontally-extending bracket component 11, (ii) an anti-slip coating or layer (not shown) (e.g., a rubber coating or layer) along at least a portion of the upper surface of the horizontally-extending bracket component 11, or (iii) both (i) and (ii).

70. The bed sheet retention device 200 of any one of embodiments 60 to 69, wherein said horizontally-extending bracket component 11 comprises an outer bracket periphery 19, and at least one aperture (not shown) extending through the horizontally-extending bracket component 11 within the outer bracket periphery 19.

71. The bed sheet retention device 200 of any one of embodiments 60 to 70, wherein said horizontally-extending bracket component 11 comprises an outer bracket periphery 19, and a single aperture (not shown) extending through the horizontally-extending bracket component 11 within the outer bracket periphery 19.

72. The bed sheet retention device 200 of any one of embodiments 62 to 71, wherein said horizontally-extending bracket component 11, said one or more bracket side walls 46, and said one or more sheet-engaging channels 12 are integrally connected to one another.

73. The bed sheet retention device 200 of any one of embodiments 62 to 72, wherein said one or more sheet-engaging channels 12 are positioned along said upper rim 47 of said side bracket 40.

74. The bed sheet retention device 200 of any one of embodiments 60 to 73, wherein each of said one or more sheet-locking members 13 comprises (i) an upper sheet-locking channel member 13U, and a lower sheet-locking channel member 13L positioned below and spaced from said upper sheet-locking channel member 13U. See, for example, FIGS. 16, and 19-22.

75. The bed sheet retention device 100 of embodiment 74, wherein each of said upper sheet-locking channel member 13U and said lower sheet-locking channel member 13L are designed to engage with one or more sheet locking strips 30, one or more sheet locking pins (not shown), one or more attachable accessories 300, or any combination thereof. For example, in some embodiments, each of upper sheet-locking channel member 13U and lower sheet-locking channel member 13L are designed to engage with one or more sheet locking strips 30, one or more attachable accessories 300, or any combination thereof.

76. The bed sheet retention device 200 of embodiment 74 or 75, wherein each of said upper sheet-locking channel member 13U and said lower sheet-locking channel member 13L are designed to engage with a single sheet locking strip 30 or a single attachable accessory 300.

77. The bed sheet retention device 200 of any one of embodiments 74 to 76, wherein said upper sheet-locking channel member 13U comprises an upper strip engaging member 131 extending towards said lower sheet-locking channel member 13L, and said lower sheet-locking channel member 13L comprises a lower strip engaging member 132 extending towards said upper sheet-locking channel member 13U. See, for example, FIG. 1, or 3-7.

78. The bed sheet retention device 200 of embodiment 77, wherein said upper strip engaging member 131 is separated from said lower strip engaging member 132 by a strip engaging member separation distance $d_{SM}$ that is less than a strip width $W_S$ of a sheet locking strip 30. See, for example, FIGS. 20, and 22.

79. The bed sheet retention device 200 of embodiment 78, wherein said strip engaging member separation distance $d_{SM}$ is greater at a strip inlet 121 of a given sheet-engaging channel 12 (e.g., at an outer entry point 121 at which a locking strip 30 is engaged with said upper strip engaging member 131 and said lower strip engaging member 132 along the side bracket 40; see, for example, FIG. 17) than at an intermediate point 122 along a length of a given sheet-engaging channel (e.g., at an intermediate point 122 along said upper strip engaging member 131 and said lower strip engaging member 132 along the side bracket 40; see, for example, FIG. 17).

80. The bed sheet retention device 200 of embodiment 78 or 79, wherein said strip engaging member separation distance $d_{SM}$ decreases from a maximum separation distance $d_{SMM}$ at a strip inlet 121 of a given sheet-engaging channel 12 (e.g., at an outer entry point 121 at which a locking strip 30 is engaged with said upper strip engaging member 131 and said lower strip engaging member 132 along the side bracket 40; see, for example, FIG. 3) to a minimum separation distance $d_{SMN}$ at a location or length 124 along the given sheet-engaging channel 12 (e.g., at an intermediate point or intermediate point length 124 along said upper strip engaging member 131 and said lower strip engaging member 132 along the side bracket 10; see, for example, FIG. 19).

81. The bed sheet retention device 200 of embodiment 80, wherein said strip engaging member separation distance $d_{SM}$ increases from the minimum separation distance $d_{SMN}$ at the location or the length 124 along the given sheet-engaging channel 12 to an exit separation distance $d_{SME}$ at a strip outlet 125 of the given sheet-engaging channel 12, said exit separation distance $d_{SME}$ being greater than said minimum separation distance $d_{SMM}$. See again, for example, FIG. 19.

82. The bed sheet retention device 200 of any one of embodiments 60 to 81, wherein said side bracket 40 has a bracket length $L_B$ of from about 3.0 inches (in) to about 68.0 in (or any value between 3.0 in and 68.0 in, in increments of 0.1 in, e.g., 8.2 in, or any range of values between 3.0 in and 68.0 in, in increments of 0.1 in, e.g., from 6.6 in to 11.2 in), a bracket width $W_B$ of from about 3.0 in to about 16.0 in (or any value between 3.0 in and 16.0 in, in increments of 0.1 in, e.g., 9.3 in, or any range of values between 3.0 in and 16.0 in, in increments of 0.1 in, e.g., from 6.8 in to 10.2 in), and a bracket height $H_B$ of from about 1.5 in to about 12.0 in (or any value between 1.5 in and 12.0 in, in increments of 0.1 in, e.g., 8.7 in, or any range of values between 1.5 in and 12.0 in, in increments of 0.1 in, e.g., from 5.6 in to 8.8 in). See, for example, FIGS. 18A-18C. It should be understood that each side bracket 40 may have any desired bracket length $L_B$, and any desired bracket width $W_B$, and any desired bracket width $H_B$.

83. The bed sheet retention device 200 of any one of embodiments 60 to 82, wherein said side bracket 40 has a bracket length $L_B$ of from about 6.0 inches (in) to about 18.0 in, a bracket width $W_B$ of from about 6.0 in to about 10.0 in, and a bracket height $H_B$ of from about 3.0 in to about 6.0 in.

84. The bed sheet retention device 200 of any one of embodiments 60 to 83, wherein said side bracket 40 has a bracket length $L_B$ of about 16.0 to about 18.0 in, a bracket width $W_B$ of about 9.0 in, and a bracket height $H_B$ of about 3.5 in.

85. The bed sheet retention device 200 of any one of embodiments 60 to 84, wherein each of said one or more sheet-engaging channels 12 comprises a track profile having (i) a track profile length $L_{TP}$ of from about 2.5 inches (in) to about 67.5 in (or any value between 2.5 in and 67.5 in, in increments of 0.1 in, e.g., 8.2 in, or any range of values between 2.5 in and 67.5 in, in increments of 0.1 in, e.g., from 4.6 in to 7.2 in), (ii) a track profile height $H_{TP}$ of from about 0.6 in to about 3.0 in (or any value between 0.6 in and 3.0 in, in increments of 0.01 in, e.g., 0.75 in, or any range of values between 0.6 in and 3.0 in, in increments of 0.01 in, e.g., from 0.89 in to 1.65 in), and (iii) a track profile width $W_{TP}$ of from about 0.1 in to about 1.5 in (or any value between 0.1 in and 1.5 in, in increments of 0.01 in, e.g., 0.15 in, or any range of values between 0.1 in and 1.5 in, in increments of 0.01 in, e.g., from 0.16 in to 0.87 in). See, for example, FIG. 8. It should be understood that each of said one or more sheet-engaging channels 12 may independently have a track profile having any desired track profile height $H_{TP}$, and any desired track profile width $W_{TP}$.

86. The bed sheet retention device 200 of any one of embodiments 60 to 85, wherein each of said one or more sheet-engaging channels 12 comprises a track profile having (i) a track profile length $L_{TP}$ of from about 3.5 in to about 16.0 in, (ii) a track profile height $H_{TP}$ of about 1.1875 in, and (iii) a track profile width $W_{TP}$ of about 0.1875 in.

87. The bed sheet retention device 200 of any one of embodiments 60 to 86, wherein said side bracket 40 comprises a polymeric material.

88. The bed sheet retention device 200 of any one of embodiments 60 to 87, wherein said side bracket 40 comprises a fiber and/or powder/particle filled polymeric material.

89. The bed sheet retention device 200 of embodiment 87 or 88, wherein said polymeric material comprises a polyolefin, an acrylonitrile butadiene styrene copolymer (i.e., an ABS copolymer), a polycarbonate, a polyester, or any combination thereof.

90. The bed sheet retention device 200 of any one of embodiments 87 to 89, wherein said polymeric material comprises a polyolefin, an acrylonitrile butadiene styrene copolymer (i.e., an ABS copolymer), or a combination thereof.

91. The bed sheet retention device 200 of any one of embodiments 87 to 90, wherein said polymeric material comprises an acrylonitrile butadiene styrene copolymer (i.e., an ABS copolymer).

92. The bed sheet retention device 200 of any one of embodiments 88 to 92, wherein said polymeric material is filled with glass fibers and/or glass powder/particles.

93. The bed sheet retention device 200 of any one of embodiments 60 to 92, further comprising: (II) one or more sheet locking strips 30, each sheet locking strip 30 being sized and designed to engage with said one or more sheet-engaging channels 12 of said side bracket 40.

94. The bed sheet retention device 200 of any one of embodiments 60 to 93, further comprising: (II) a single sheet locking strip 30 sized and designed to engage with any one sheet-engaging channel 12 within said one or more sheet-engaging channels 12 of said side bracket 40.

95. The bed sheet retention device 200 of embodiment 93 or 94, wherein each sheet locking strip 30 has a strip width $W_S$ of from about 0.5 in to about 1.5 in, and a strip thickness $T_S$ of from about 0.05 in to about 0.10 in, and a strip length $L_S$ of from about 4.0 in to about 18.0 in.

96. The bed sheet retention device 200 of any one of embodiments 93 to 95, wherein each sheet locking strip 30 has a strip width $W_S$ of from about 0.8 in to about 1.2 in, and a strip thickness $T_S$ of from about 0.05 in to about 0.08 in, and a strip length $L_S$ of from about 12.0 in to about 16.0 in.

97. The bed sheet retention device 200 of any one of embodiments 93 to 96, wherein each sheet locking strip 30 has a strip width $W_S$ of about 1.0 in, and a strip thickness $T_S$ of about 0.0625 in, and a strip length $L_S$ of about 15.5 in.

98. The bed sheet retention device 200 of any one of embodiments 93 to 97, wherein each sheet locking strip 30 has (1) a 0.5 in radius on each strip corner 31 to make each strip end 32 round, and (2) strip edges 33 that are radiused at about 0.03125 in to provide a smooth finish without corners or edges.

99. The bed sheet retention device 200 of any one of embodiments 93 to 98, wherein each sheet locking strip 30 comprises an acrylic material or a polycarbonate material.

100. The bed sheet retention device 200 of any one of embodiments 93 to 99, wherein each sheet locking strip 30 comprises an acrylic material.

101. A bed sheet retention device 200 comprising: (I) a side bracket 40 comprising: (a) a horizontally-extending bracket component 11 sized and designed to extend between a bottom surface 51 of a mattress 50 and a support surface 60 under the bottom surface 51; and (b) one or more sheet-engaging channels 12 connected to said horizontally-extending bracket component 11, wherein each sheet-engaging channel 12 (1) comprises a sheet-locking member 13 extending along an outer surface 46 of the side bracket 40, (2) extends substantially within a plane P parallel with said horizontally-extending bracket component 11 and (3) each independently comprising (i) an upper sheet-locking channel member 13U, and (ii) a lower sheet-locking channel member 13L positioned below and spaced from said upper sheet-locking channel member 13U, wherein each of said upper sheet-locking channel member 13U and said lower sheet-locking channel member 13L are designed to engage with one or more sheet locking strips 30 describe herein and/or one or more of the herein-described attachable accessories 300 describe herein; and (II) one or more sheet locking strips 30, each of the one or more sheet locking strips 30 being sized and designed to engage with any one sheet-engaging channel 12 within said one or more sheet-engaging channels 12 of said side bracket 40. See, for example, exemplary bed sheet retention device 200 shown in FIGS. 20 and 2223, and plane P in FIG. 18A.

102. The bed sheet retention device 200 of embodiment 101, wherein said one or more sheet-engaging channels 12 comprises a single sheet-locking member 13.

103. The bed sheet retention device 200 of embodiment 101, wherein said one or more sheet-engaging channels 12 comprises two or three sheet-locking members 13 with each sheet-engaging channel 12 being parallel with one another.

104. The bed sheet retention device 200 of any one of embodiments 101 to 103, wherein said bed sheet retention device 200 comprises one or more features recited in any one of embodiments 60 to 100.

105. The bed sheet retention device 100 of any one of embodiments 60 to 104, further comprising: (III) one or more accessories 300, wherein each accessory 300 comprises: (a) at least one accessory connecting member 301, and (b) an accessory body 302 connected to and extending from the at least one accessory connecting member 301, wherein the at least one accessory connecting member 301 is configured (i.e., designed) to extend within and connect to the one or more sheet-engaging channels 12 of the side bracket 10.

Accessories Embodiments

106. An accessory 300 comprising: (a) at least one accessory connecting member 301, and (b) an accessory body 302 connected to and extending from the at least one accessory connecting member 301, wherein the at least one accessory connecting member 301 is configured (i.e., designed) to extend within and connect to one or more sheet-engaging channels 12 of a bracket 10/40 of a bed sheet retention device 100/200 so as to position at least a portion of said accessory body 302 (*i*) above the one or more sheet-engaging channels 12, and/or (ii) below the one or more sheet-engaging channels 12, and/or (iii) within a horizontal plane P containing the one or more sheet-engaging channels 12.

107. The accessory 300 of embodiment 106, wherein said at least one accessory connecting member 301 comprises a single accessory connecting member 301. See, for example, exemplary accessories 300 shown in FIGS. 10A-10B.

108. The accessory 300 of embodiment 106, wherein said at least one accessory connecting member 301 comprises two or more accessory connecting members 301. See, for example, exemplary accessories 300 shown in FIGS. 11A-11B.

109. The accessory 300 of any one of embodiments 106 to 108, wherein each of said at least one accessory connecting member 301 comprises a vertically-extending connecting strip component 303 attached to said accessory body 302.

110. The accessory 300 of any one of embodiments 106 to 109, wherein each of said at least one accessory connecting member 301 comprises a vertically-extending connecting strip component 303 attached to said accessory body 302 via one or more intermediate connecting members 304. See, for example, exemplary accessories 300 shown in FIGS. 10A-11B.

111. The accessory 300 of embodiment 110, wherein each vertically-extending connecting strip component 303 has a connecting strip component width $W_{CSC}$ of from about 0.1 in to about 1.5 in (or any value between 0.1 in and 1.5 in, in increments of 0.01 in, e.g., 0.52 in, or any range of values between 0.1 in and 1.5 in, in increments of 0.01 in, e.g., from 0.59 in to 1.35 in), and a connecting strip component thickness $T_{CSC}$ of from about 0.25 in to about 3.0 in (or any value between 0.25 in and 3.0 in, in increments of 0.01 in, e.g., 0.52 in, or any range of values between 0.25 in and 3.0 in, in increments of 0.01 in, e.g., from 0.59 in to 1.65 in), and a connecting strip component length $L_{CSC}$ of from about 2.0 in to about 18.0 in (or any value between 2.0 in and 18.0 in, in increments of 0.01 in, e.g., 3.5 in, or any range of values between 2.0 in and 18.0 in, in increments of 0.01 in, e.g., from 3.80 in to 5.65 in).

112. The accessory 300 of embodiment 110 or 111, wherein each vertically-extending connecting strip component 303 has a connecting strip component width $W_{CSC}$ of from about 0.8 in to about 1.2 in, and a connecting strip component thickness $T_{CSC}$ of from about 0.05 in to about 0.08 in, and a connecting strip component length $L_{CSC}$ of from about 4.0 in to about 12.0 in.

113. The accessory 300 of any one of embodiments 110 to 112, wherein each vertically-extending connecting strip component 303 has a connecting strip component width $W_{CSC}$ of about 1.0 in, and a connecting strip component thickness $T_{CSC}$ of about 0.0625 in, and a connecting strip component length $L_{CSC}$ of about 5.5 in.

114. The accessory 300 of any one of embodiments 110 to 113, wherein each vertically-extending connecting strip component 303 has (1) a 0.5 in radius on each connecting strip component corner to make each connecting strip end 305 round, and (2) connecting strip edges 306 that are radiused at about 0.03125 in to provide a smooth finish without corners or edges.

115. The accessory 300 of any one of embodiments 110 to 114, wherein each of (i) said at least one accessory connecting member 301, (ii) said accessory body 302, and (iii) said one or more intermediate connecting members 304 independently comprises a polymeric material with or without fillers/reinforcements. Suitable fillers/reinforcements include, but are not limited to, glass fibers, glass powder/particles, carbon fibers, aramid fibers, other polymeric fibers, one or more fabrics (e.g., woven fabrics, nonwoven fabrics, etc.) made from any of the herein-described materials, or any combination thereof.

116. The accessory 300 of any one of embodiments 110 to 115, wherein each of (i) said at least one accessory connecting member 301, (ii) said accessory body 302, and (iii) said one or more intermediate connecting members 304 independently comprises a polymeric material with fillers/reinforcements therein.

117. The accessory 300 of any one of embodiments 110 to 116, wherein each of (i) said at least one accessory connecting member 301, (ii) said accessory body 302, and (iii) said one or more intermediate connecting members 304 independently comprises an acrylic material or a polycarbonate material.

118. The accessory 300 of any one of embodiments 110 to 117, wherein each of (i) said at least one accessory connecting member 301, (ii) said accessory body 302, and (iii) said one or more intermediate connecting members 304 independently comprises an acrylic material.

119. The accessory 300 of any one of embodiments 110 to 118, wherein each of (i) said at least one accessory connecting member 301, (ii) said accessory body 302, and (iii) said one or more intermediate connecting members 304 independently comprises glass fibers, glass powder/particles, and/or one or more glass fiber containing fabrics.

Figure 28:
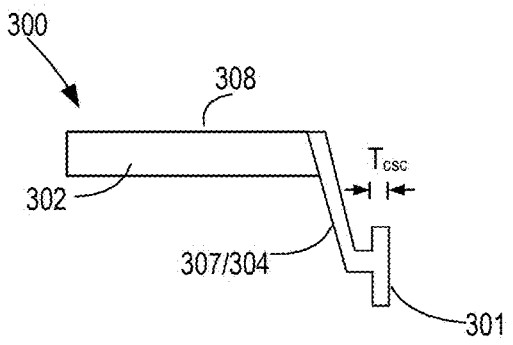
FIG. 28 depicts a side view of another exemplary accessory suitable for use with the disclosed brackets.

120. The accessory 300 of any one of embodiments 106 to 119, wherein said accessory body 302 is connected to said at least one accessory connecting member 301 so that a portion or all of said accessory body 302 is positioned above said at least one accessory connecting member 301. See, for example, exemplary accessory 300 in FIG. 28.

121. The accessory 300 of any one of embodiments 106 to 120, wherein said accessory body 302 is connected to said at least one accessory connecting member 301 so that a portion or all of said accessory body 302 is positioned below said at least one accessory connecting member 301.

122. The accessory 300 of any one of embodiments 106 to 121, wherein said accessory body 302 comprises an accessory body surface 308 that is structurally capable of supporting an object (not shown) resting on and/or connected to the accessory body surface 308.

123. The accessory 300 of any one of embodiments 106 to 122, wherein said accessory body 302 comprises an accessory body surface 308 that is structurally capable of supporting an object (not shown) resting on and/or connected to the accessory body surface 308, wherein the object comprises one or more of a book, a drink container (e.g., a cup or glass or bottle), a food container (e.g., a plate of food), a computer pad, a laptop computer, a cell phone, a lamp, a television remote, an air freshener, a picture frame, vehicle keys, etc., or any combination thereof.

124. The accessory 300 of any one of embodiments 106 to 123, wherein a position of said accessory body 302 relative to said at least one accessory connecting member 301 is adjustable within a horizontal plane PH. For example, the accessory body 302 can be moved towards or away from the at least one accessory connecting member 301 within a given horizontal plane PH.

125. The accessory 300 of any one of embodiments 106 to 124, wherein a position of said accessory body 302 relative to said at least one accessory connecting member 301 is adjustable within a vertical plane Pv. For example, the accessory body 302 can be moved up or down relative to the at least one accessory connecting member 301 within a given horizontal plane PH.

126. The accessory 300 of any one of embodiments 106 to 125, wherein a position of said accessory body 302 relative to said at least one accessory connecting member 301 is adjustable within a horizontal plane PH and a vertical plane Pv.

127. The accessory 300 of any one of embodiments 110 to 126, wherein said one or more intermediate connecting members 304 comprises a connecting arm 307 extending between said accessory body 302 and said at least one accessory connecting member 301.

Figure 29A:
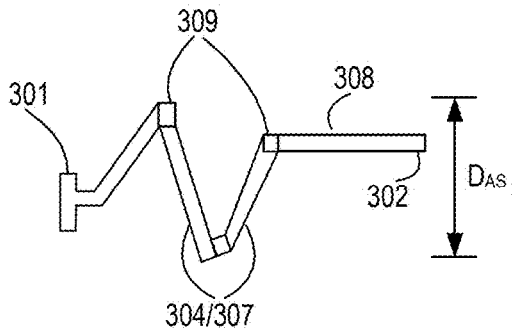
FIGS. 29A-29B depict side views of another exemplary accessory suitable for use with the disclosed brackets.
Figure 29B:
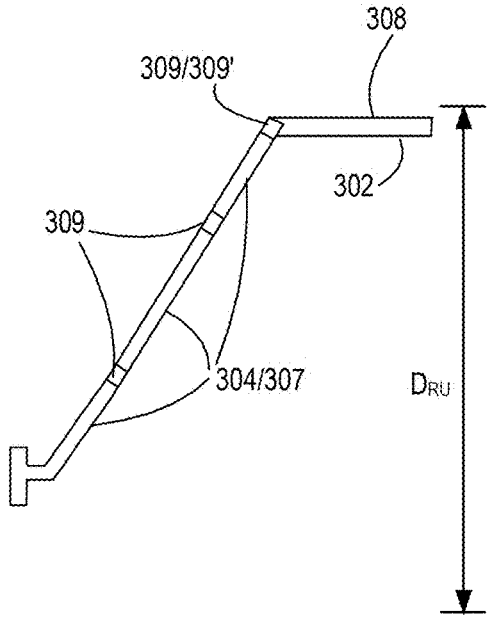

128. The accessory 300 of any one of embodiments 110 to 127, wherein said one or more intermediate connecting members 304 comprises a jointed connecting arm 307' extending between said accessory body 302 and said at least one accessory connecting member 301, said jointed connecting arm 307' (a) comprising one or more joints 309, and (b) enabling movement of said accessory body 302 so that a position of said accessory body 302 relative to said at least one accessory connecting member 301 is adjustable within (i) a horizontal plane PH, (ii) a vertical plane Pv, or (iii) both a horizontal plane PH, and a vertical plane Pv. See, for example, exemplary accessory 300 shown in FIGS. 29A-29B, wherein a portion of said accessory body 302 (e.g., accessory body surface 308) is positioned within a storage range DRS (i.e., a portion of accessory body 302 (e.g., accessory body surface 308) is within the range DRS shown in FIG. 29A during storage), but may be positioned anywhere within use range DRU shown in FIG. 29B).

129. The accessory 300 of any one of embodiments 110 to 128, wherein at least one joint 309 of said one or more joints 309 comprises a joint 309' that allows rotation of a portion of said accessory body 302 (e.g., accessory body surface 308) along a line extending through the joint 309'. See again, for example, exemplary accessory 300 shown in FIG. 29B with joint 309' proximate accessory body surface 308.

Figure 26A:
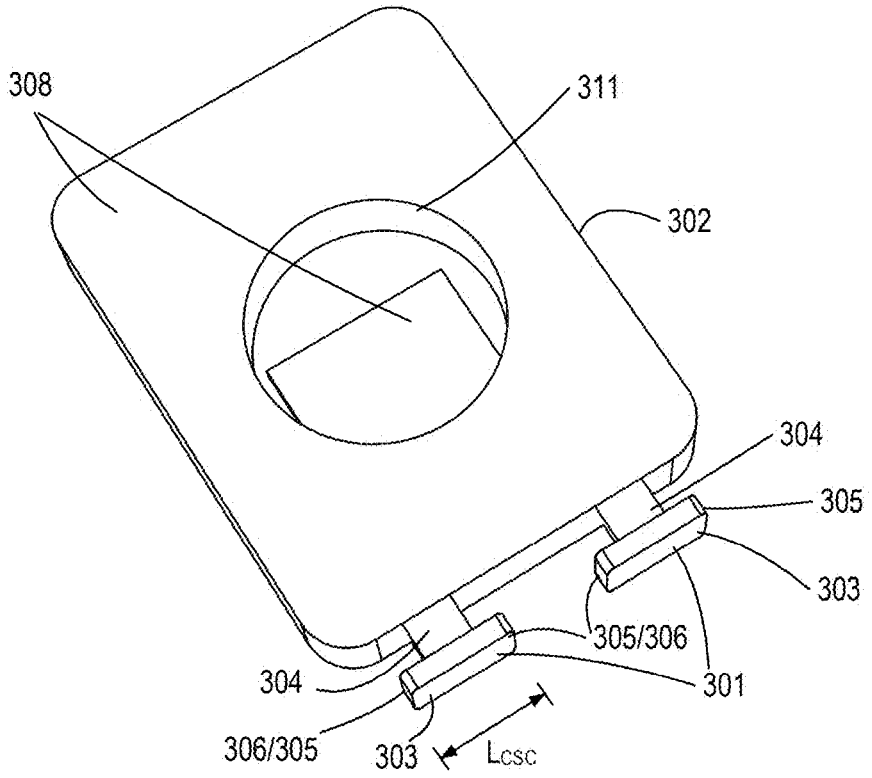
FIG. 26A depicts a perspective view of another exemplary accessory suitable for use with the disclosed bed sheet retention devices, and in the disclosed bed sheet retention systems.
Figure 26B:
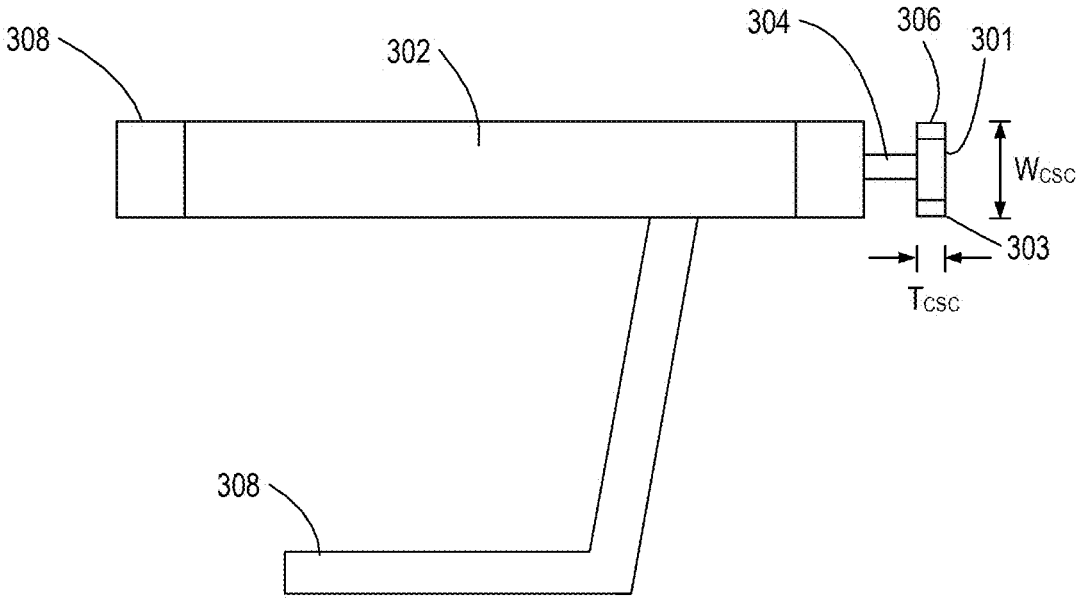
FIG. 26B depicts a side view of the exemplary accessory shown in FIG. 26A.
Figure 27A:
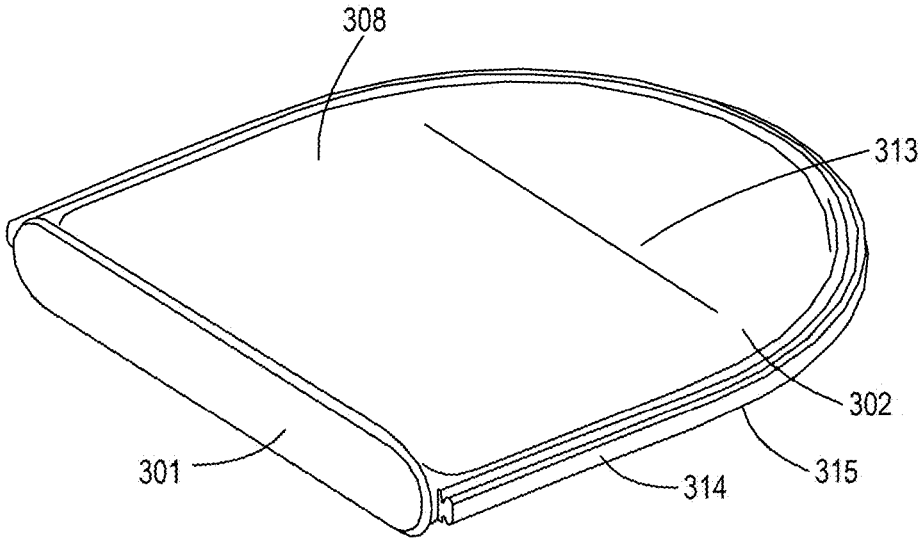
FIG. 27A depicts a perspective view of another exemplary accessory suitable for use with the disclosed bed sheet retention devices, and in the disclosed bed sheet retention systems.
Figure 31A:
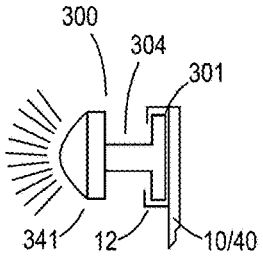
FIGS. 31A-31H depict side views of various exemplary accessories suitable for use with the disclosed brackets.
Figure 31B:
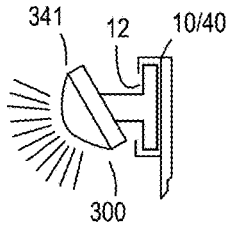
Figure 31C:
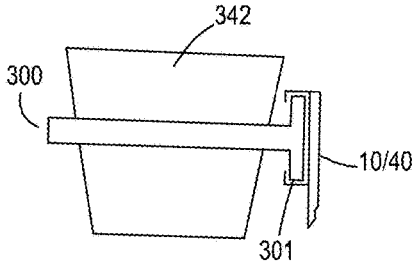
Figure 31D:
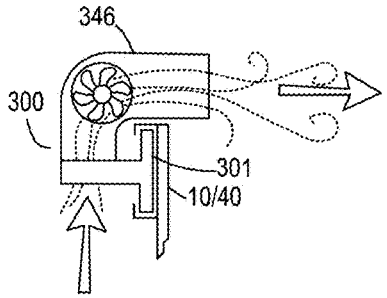
Figure 31E:
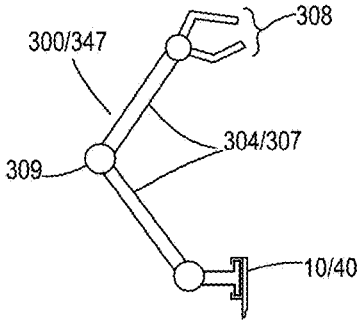
Figure 31F:
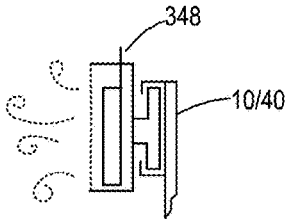
Figure 31G:
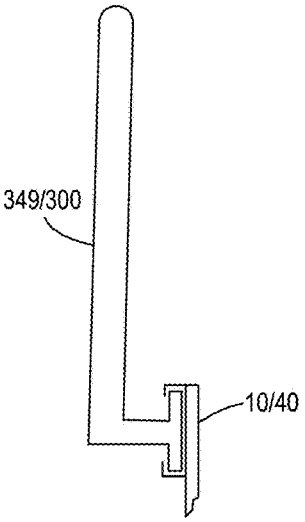
Figure 31H:
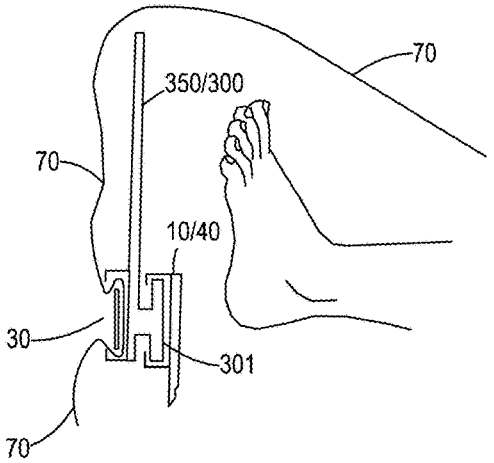

130. The accessory 300 of any one of embodiments 106 to 126, wherein said accessory body 302 comprises one or more features selected from: (i) a ledge or rim 313 (see, FIG. 27A) extending along an accessory body surface 308 of said accessory body 302, (ii) a hole 311 extending through an accessory body surface 308 of said accessory body 302, (iii) a clip or clamping member (not shown) suitable for fastening an object (e.g., a book, a phone, a computer pad or tablet, etc.) to an accessory body surface 308 of said accessory body 302, (iv) a clothes hanger for hanging one or more items of clothing (not shown), (v) a towel rack for hanging one or more towels (not shown), (vi) a scented or scent-generating component to provide a scent in the area near accessory body 302, (vii) a cup-/glass-holding feature (see, exemplary cup-holding accessory 300 shown in FIGS. 26A-26B, and exemplary cup-holder accessory 300 holding cup 342 shown in FIG. 31C, (viii) a bedside holster (i.e., for a hand gun or long gun), (ix) a bedside light/lamp 341 as shown in FIG. 31A or FIG. 31B, a fan 346 as shown in FIG. 31D, an articulated arm 347 as shown in FIG. 31E, a scent pod 348 as shown in FIG. 31F, a bed railing 349 as shown in FIG. 31G, a kickstand component 346 as shown in FIG. 31H, or any combinations thereof. It should be noted that any of the above-described accessories 300 could further comprise another sheet-engaging channel 12 along an outer surface of the accessory 300 similar to kickstand component 346 shown in FIG. 31H. For example, fan 346 shown in FIG. 31D could have a sheet-engaging channel 12 along body accessory 302 opposite the accessory connecting member 301. Such configurations can result in parallel sheet-engaging channels 12 within a horizontal plane such as horizontally-extending plane P.

131. The accessory 300 of any one of embodiments 106 to 130, wherein said accessory body 302 comprises one or more electronic components therein and/or thereon (not shown), the one or more electronic components comprising one or more of (i) a phone charging outlet, (ii) a 120V outlet (e.g., a standard home outlet), (iii) a music-generating device (e.g., a music speaker and/or Bluetooth component), (iv) a television screen or computer screen, (v) a charging pad (i.e., induction charging), and/or (vi) a medical device (e.g., to monitor a patient, to display patient information, etc.).

Figure 25A:
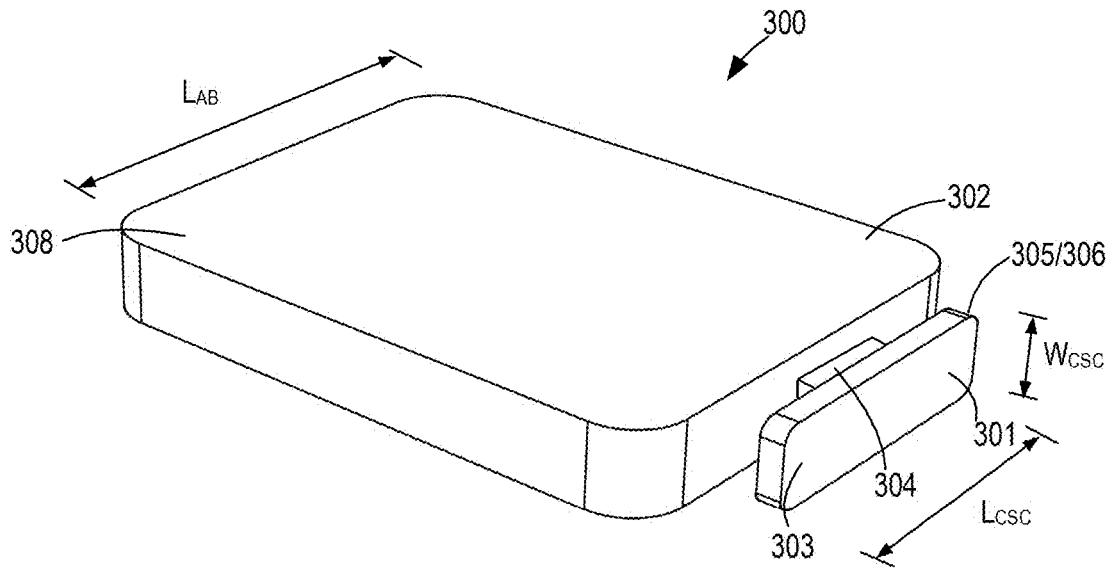
FIG. 25A depicts a perspective view of an exemplary accessory suitable for use with the disclosed bed sheet retention devices, and in the disclosed bed sheet retention systems.
Figure 25B:
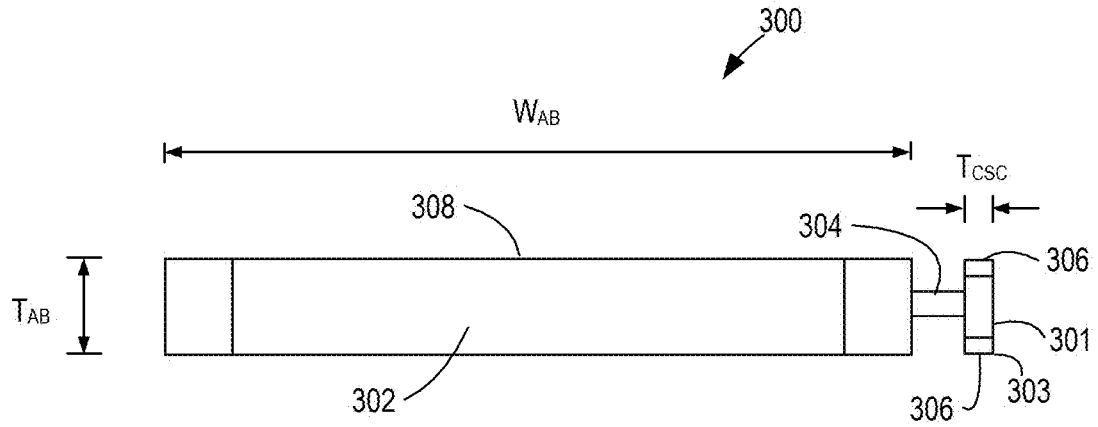
FIG. 25B depicts a side view of the exemplary accessory shown in FIG. 25A.

132. The accessory 300 of any one of embodiments 106 to 131, wherein said accessory body 302 has an accessory body width $W_{AB}$ of from about 0.5 in to about 18.0 in, an accessory body length LAB of from about 0.5 in to about 24.0 in, and an accessory body thickness TAB of from about 0.25 in to about 12.0 in, depending on the overall shape and configuration of the accessory body 302. For example, when the accessory body 302 comprises a bedside tabletop accessory 300, such as shown in FIGS. 25A-25B, the accessory body 302 will typically have a larger accessory body width $W_{AB}$, a larger accessory body length LAB, and a smaller accessory body thickness TAB when compared to the accessory body 302 of cup-holding accessory 300 shown in FIGS. 26A-26B. It should be understood that a given accessory body 302 can have any desired accessory body width $W_{AB}$, any desired accessory body length LAB, and any desired accessory body thickness TAB as long as the resulting accessory body 302 is supported by the at least one accessory connecting member 301 positioned within the one or more sheet-engaging channels 12 of bracket 10/40 of bed sheet retention device 100/200.

133. The accessory 300 of any one of embodiments 106 to 132, wherein said accessory body 302 has an accessory body width $W_{AB}$ of from about 4.0 in to about 14.0 in, an accessory body length LAB of from about 4.0 in to about 16.0 in, and an accessory body thickness TAB of from about 0.5 in to about 6.0 in, depending on the overall shape and configuration of the accessory body 302.

134. The accessory 300 of any one of embodiments 106 to 133, wherein said accessory body 302 has an accessory body width $W_{AB}$ of from about 6.0 in to about 12.0 in, an accessory body length LAB of from about 6.0 in to about 12.0 in, and an accessory body thickness TAB of from about 0.5 in to about 3.0 in, depending on the overall shape and configuration of the accessory body 302.

135. The accessory 300 of any one of embodiments 106 to 134, wherein said accessory body 302 comprises an accessory body surface 308 having an accessory body outer periphery 315, and one or more accessory body connectors 314 positioned along said accessory body outer periphery 315, said one or more accessory body connectors 314 enabling connection of one or more accessory body components to said accessory body 302. See, for example, exemplary accessory 300 shown in FIG. 27A.

136. The accessory 300 of embodiment 135, wherein said one or more accessory body connectors 314 comprises a single accessory body connector 314 extending along said accessory body outer periphery 315.

Figure 27B:
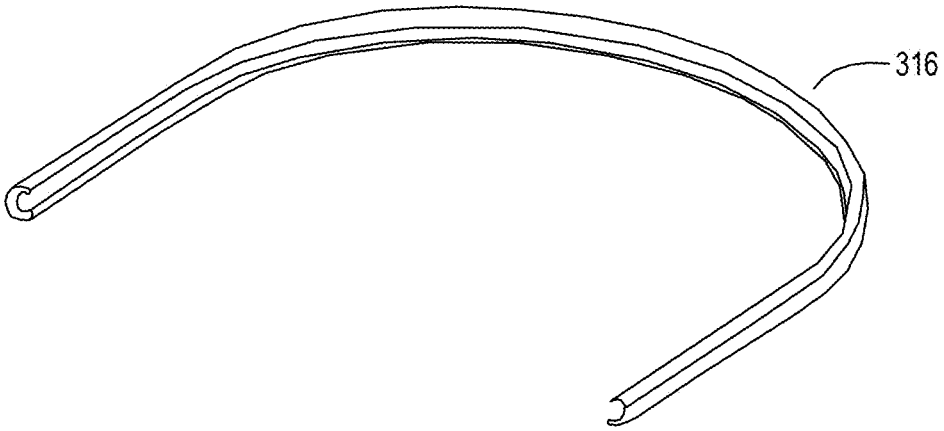
FIG. 27B depicts a perspective view of an exemplary clamping member suitable for use with the exemplary accessory shown in FIG. 27A.

137. The accessory 300 of embodiment 135 or 136, further comprising one or more attachable connectors 316, each of the one or more attachable connectors 316 being designed to attach/connect to and detach/disconnect from said one or more accessory body connectors 314. See, for example, exemplary accessory 300 and exemplary attachable connector 316 shown in FIGS. 27A-27B.

Figure 27C:
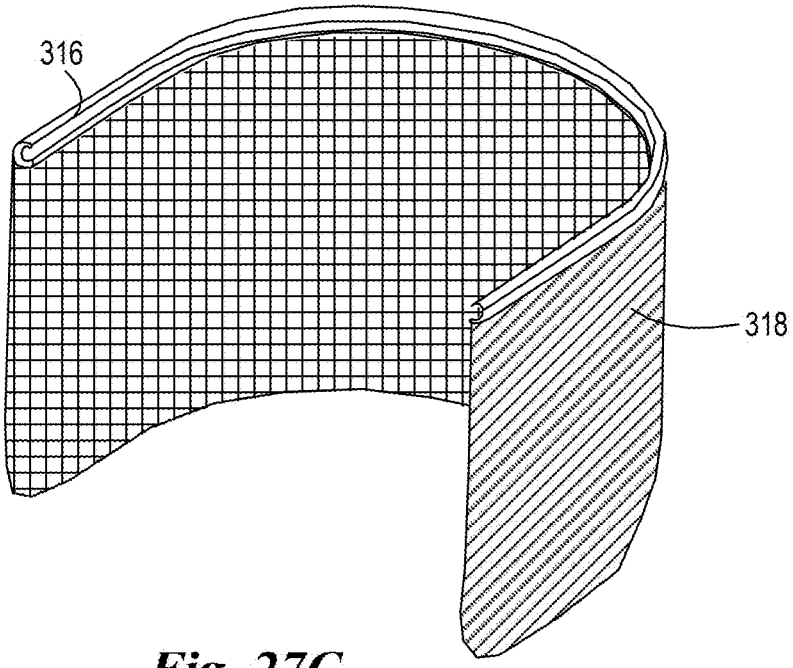
FIG. 27C depicts a perspective view of an exemplary skirt suitable for use with the exemplary accessory shown in FIG. 27A.
Figure 27D:
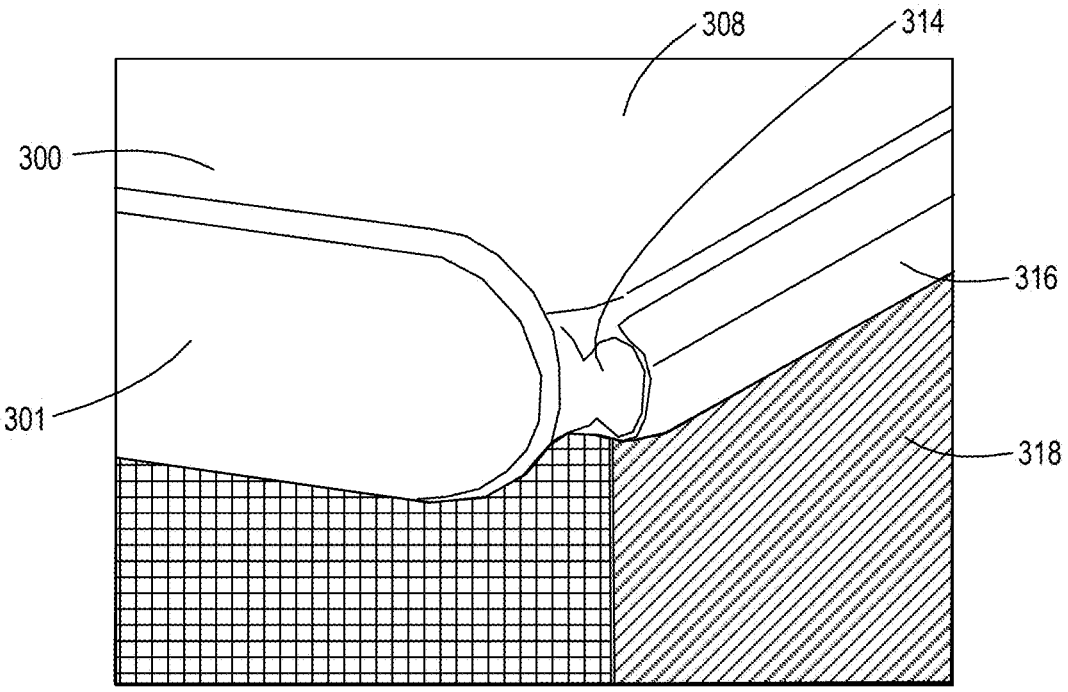
FIG. 27D depicts a close-up view of the exemplary skirt shown in FIG. 27C attached to an outer rim of the exemplary accessory shown in FIG. 27A via the exemplary clamping member shown in FIG. 27B.
Figure 27E:
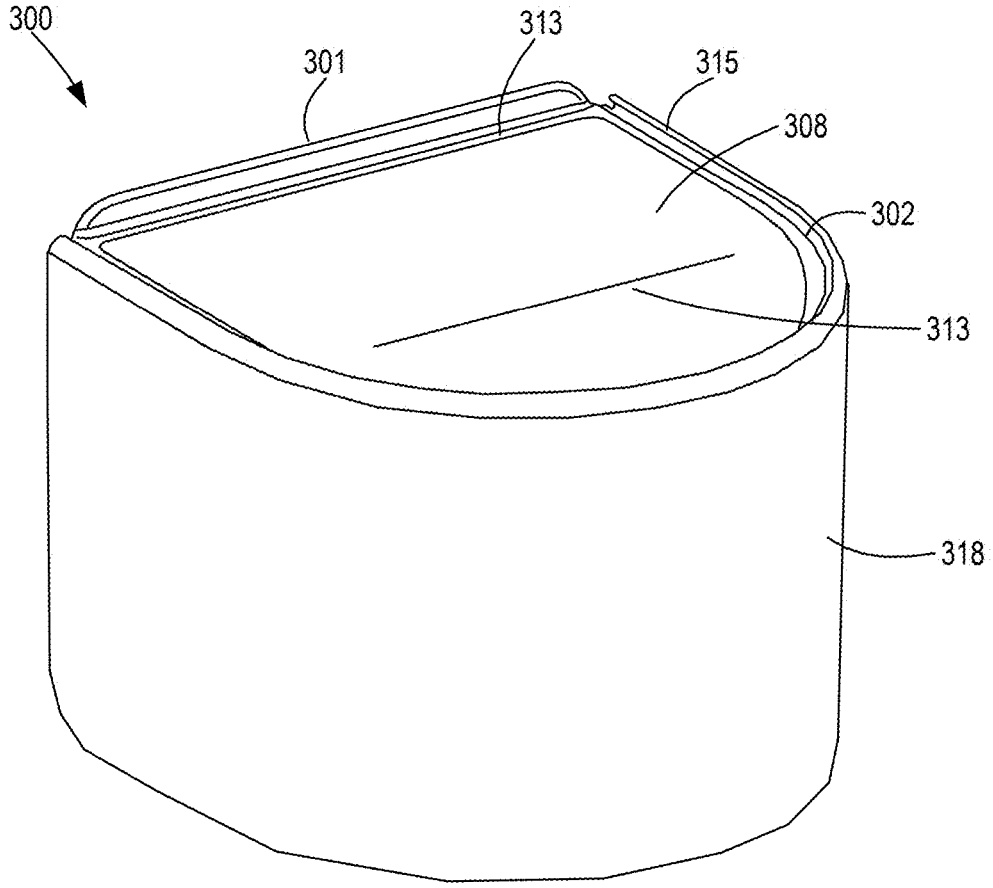
FIG. 27E depicts a perspective front view of an exemplary accessory combination comprising the exemplary accessory shown in FIG. 27A with the exemplary skirt shown in FIG. 27C attached to an outer rim thereof via the exemplary clamping member shown in FIG. 27B.

138. The accessory 300 of any one of embodiments 135 to 137, further comprising one or more attachable materials 318, each of the one or more materials 318 being designed to attach/connect to and detach/disconnect from said one or more accessory body connectors 314 via one or more attachable connectors 316. See, for example, exemplary attachable material 318, namely, skirt 318, shown in FIG. 27C. Also, see exemplary accessory 300 in FIG. 27D-27E, wherein exemplary attachable material 318, namely, skirt 318, is attached to single accessory body connector 314 along accessory body outer periphery 315 via attachable connector 316, As shown in this embodiment, attachable connector 316 clamps over a portion of skirt 318 onto single accessory body connector 314 of accessory body 302.

139. The accessory 300 of any one of embodiments 106 to 138, wherein said accessory 300 is attached to a bracket 10/40 of a bed sheet retention device 100/200 so as to position at least a portion of said accessory body 302 (*i*) above the one or more sheet-engaging channels 12, and/or (ii) below the one or more sheet-engaging channels 12, and/or (iii) within a horizontal plane P containing the one or more sheet-engaging channels 12.

140. The accessory 300 of any one of embodiments 106 to 139, wherein said accessory 300 is attached to a bracket 10/40 comprising the corner bracket 10 described in embodiments 9 to 59.

141. The accessory 300 of any one of embodiments 106 to 139, wherein said accessory 300 is attached to a bracket 10/40 comprising the side bracket 40 described in embodiments 60 to 105.

Bed Sheet Retention Systems and Kit Embodiments

142. A bed sheet retention system (or kit) 1000 comprising: (I) one or more of the herein-described brackets 10/40; and (II) one or more of the herein-described sheet locking strips 30.

143. The bed sheet retention system (or kit) 1000 of embodiment 142, wherein the one or more brackets 10/40 comprise at least one corner bracket 10 as described in embodiments 9 to 59.

144. The bed sheet retention system (or kit) 1000 of embodiment 143, wherein the at least one corner bracket 10 comprises four or more corner brackets 10.

145. The bed sheet retention system (or kit) 1000 of any one of embodiments 142 to 145, wherein the at least one corner bracket 10 comprises at least one side bracket 40 as described in embodiments 60 to 105.

146. The bed sheet retention system (or kit) 1000 of embodiment 145, wherein said at least one side bracket 40 comprises two or more side brackets 40 (e.g., from 2 to 8 side brackets 40).

147. The bed sheet retention system (or kit) 1000 of any one of embodiments 142 to 146, wherein said one or more of the herein-described sheet locking strips 30 comprises four or more sheet locking strips 30.

148. The bed sheet retention system (or kit) 1000 of any one of embodiments 142 to 147, further comprising one or more of the herein-described accessories 300.

149. The bed sheet retention system (or kit) 1000 of any one of embodiments 142 to 147, further comprising one or more inflatable bladders 80, each inflatable bladder 80 being usable with and/or connectable to one of the herein described brackets 10/40. See, for example, FIGS. 30A-30C, which disclose exemplary inflatable bladder 80 in combination with exemplary corner bracket 10.

150. The bed sheet retention system (or kit) 1000 of embodiment 149, wherein said inflatable bladder 80 connects to one of the herein described brackets 10/40.

151. The bed sheet retention system (or kit) 1000 of embodiment 149 or 150, wherein said inflatable bladder 80 connects to an aperture 20 within a corner bracket 10.

Figure 30A:
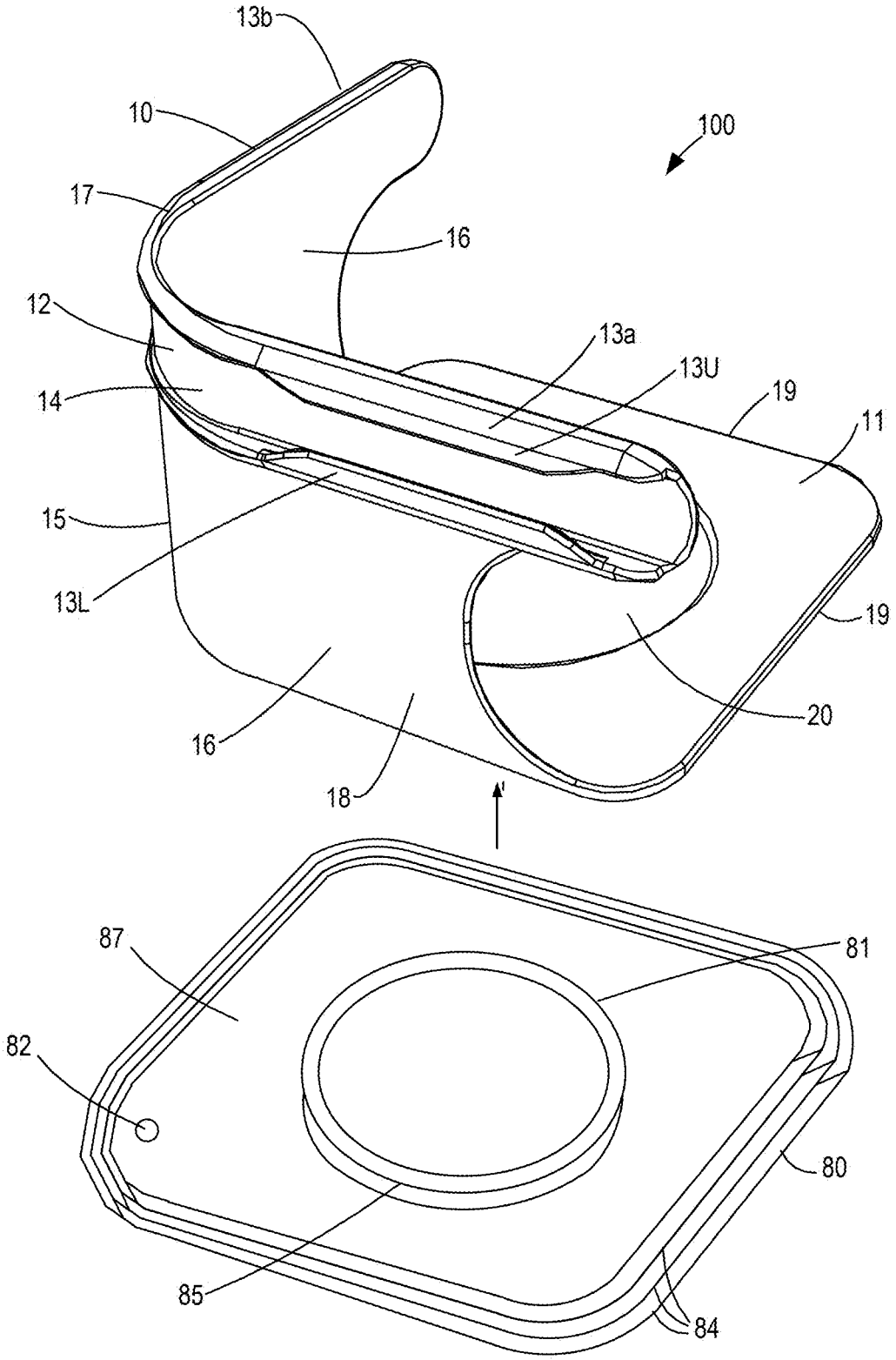
FIG. 30A depicts a perspective view the exemplary corner bracket of FIG. 1 in combination with an inflatable bladder suitable for use with any of the disclosed brackets.

152. The bed sheet retention system (or kit) 1000 of any one of embodiments 149 to 151, wherein said inflatable bladder 80 comprises a bladder fluid inlet 82 (e.g., an air inlet 82). It should be noted that bladder fluid inlet 82 can be along any outer surface of said inflatable bladder 80. In some embodiments, inflatable bladder 80 comprises a bladder fluid inlet 82 along an upper surface 87 of inflatable bladder 80 (as shown in FIG. 30A), and bracket 10/40 (e.g., corner bracket 10) has an opening 120 therein so that a fluid hose 88 (e.g., an air hose 88) can be connected to bladder fluid inlet 82.

153. The bed sheet retention system (or kit) 1000 of any one of embodiments 149 to 152, wherein said inflatable bladder 80 comprises a bladder rim 81 connected to an upper surface 87 of the inflatable bladder 80 via a bladder neck component 85. The bladder rim 81 and bladder neck component 85 are designed and sized to extend through an aperture 20 within a bracket 10/40 (e.g., corner bracket 10) so that bladder rim 81 rests along an upper surface of horizontally-extending bracket component 11 surrounding aperture 20.

Figure 30B:
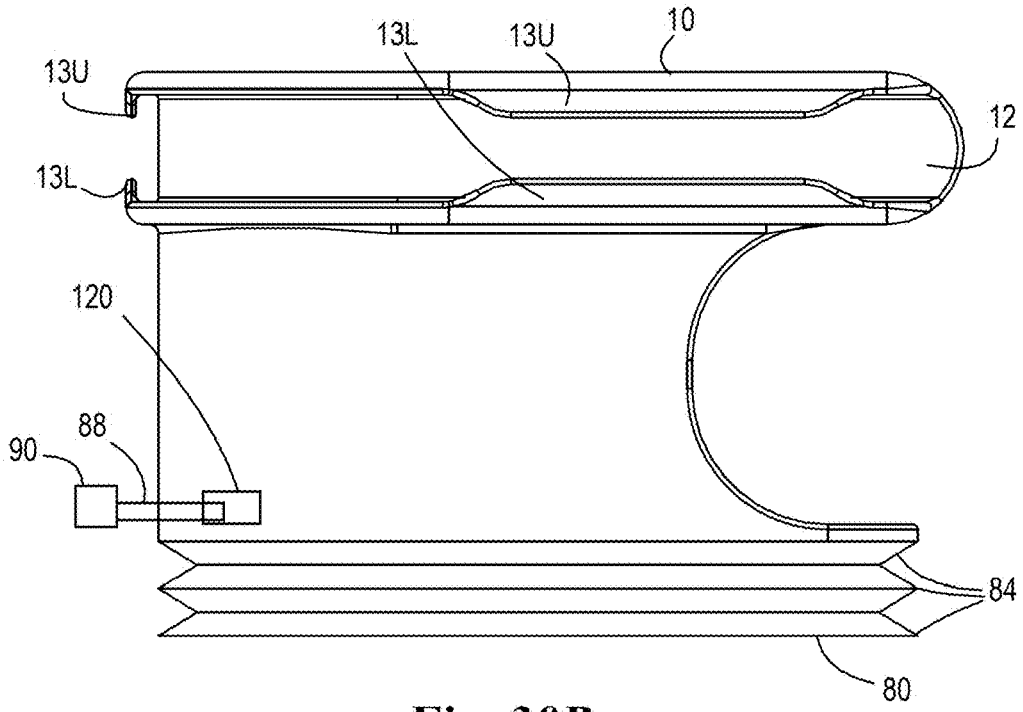
FIGS. 30B-30C depict side views of the exemplary combination shown in FIG. 30A with FIG. 30B showing a view wherein the inflatable bladder is not inflated, and with FIG. 30C showing a view wherein the inflatable bladder is inflated.

154. The bed sheet retention system (or kit) 1000 of any one of embodiments 149 to 153, wherein said inflatable bladder 80 comprises two or more expandable folds 84 that separate from one another when inflatable bladder 80 is inflated. See, for example, uninflated inflatable bladder 80 shown in FIG. 30B, compared to inflated inflatable bladder 80 shown in FG. 30C. It should be understood that a given inflatable bladder 80 may have any desired number of expandable folds 84 therein.

155. The bed sheet retention system (or kit) 1000 of any one of embodiments 149 to 154, further comprising a fluid hose 88 (e.g., an air hose 88) that connects a fluid source 90 to a bladder fluid inlet 82 (e.g., an air inlet 82) of the inflatable bladder 80.

156. The bed sheet retention system (or kit) 1000 of any one of embodiments 149 to 155, further comprising a fluid source 90 (e.g., an air source) that can be used to inflate the inflatable bladder 80. The fluid source 90 could be a hand-help pump (not shown) or a foot pump (not shown) or an electric pump (not shown) or any other type of fluid pump.

It should be understood that the bed sheet retention systems (or kits) 1000 of the present invention may comprise one or more additional system/kit components. Suitable additional system/kit components include, but are not limited to, one or more bed sheets 70, one or more sheet connectors (not shown) other than said sheet locking strips 30, one or more bedmaking tool/mattress-lift tools as described in U.S. patent application Ser. No. 17/983,628, filed on Nov. 9, 2022, and entitled "BEDMAKING TOOLS AND METHODS OF MAKING AND USING THE SAME," the subject matter of which is hereby incorporated by reference in its entirety, one or more bungee cord-type connectors (not shown) that can be used to attached two bed sheet retention devices 100 to one another, diagonally, under a given mattress 50 (i.e., connecting two diagonally opposed bed sheet retention devices 100 to one another via the at least one aperture 20 within each bed sheet retention device 100), and any combination thereof.

Methods of Making Bed Sheet Retention Devices And Accessories Embodiments

157. A method of making (a) the bed sheet retention device 100/200 of any one of embodiments 1 to 105, or (b) the accessories 300 of any one of embodiments 106 to 141, said method comprising: forming the corner bracket 10, the side bracket 10, and/or the accessory 300 utilizing one or more steps comprising: one or more thermoforming steps (e.g., a molding steps); one or more machining steps (e.g., one or more drilling, cutting, stamping, sanding, abrading, etc., steps); and one or more assembling steps.

158. The method of embodiment 157, wherein said forming step comprises: one or more thermoforming steps (e.g., a molding steps).

159. The method of embodiment 157 or 158, wherein said forming step comprises: a single thermoforming step (e.g., a molding step).

Methods of Using Bed Sheet Retention Devices and Accessories Embodiments

160. A method of using the bed sheet retention device 100/200 of any one of embodiments 1 to 105, said method comprising: inserting the horizontally-extending bracket component 11 between a bottom surface 51 of a mattress 50 and a support surface 60 under the bottom surface 51; and engaging a sheet material 70 with the one or more sheet-engaging channels 12 of the corner bracket 10, and/or the side bracket 10.

161. The method of embodiment 160, wherein said engaging step comprises: engaging a first sheet material portion 71 of a first sheet 70 with the one or more sheet-engaging channels 12 of the corner bracket 10, and/or the side bracket 10. See again, FIG. 15.

162. The method of embodiment 160 or 161, wherein said engaging step comprises: engaging two separate sheets 70 (not shown) with the one or more sheet-engaging channels 12 of the corner bracket 10, and/or the side bracket 10.

163. The method of any one of embodiments 160 to 162, wherein said engaging step comprises: engaging two separate sheets 70 (not shown) with a single sheet-engaging channel 12 of the corner bracket 10, and/or the side bracket 10.

164. The method of any one of embodiments 160 to 162, wherein said engaging step comprises: engaging two separate sheets 70 (not shown) with two or more sheet-engaging channels 12 of the corner bracket 10, and/or the side bracket 10.

165. The method of any one of embodiments 160 to 164, wherein said engaging step comprises: inserting the one or more sheet locking strips 30 recited in any one of embodiments 47 to 54 into the one or more sheet-engaging channels 12 of the corner bracket 10, and/or the side bracket 10.

166. The method of any one of embodiments 160 to 165, wherein said engaging step comprises: independently inserting a single sheet locking strip 30 recited in any one of embodiments 47 to 54 into the one or more sheet-engaging channels 12 of the corner bracket 10, and/or the side bracket 10.

167. The method of any one of embodiments 160 to 166, wherein said method comprises: utilizing the bed sheet retention system (or kit) 1000 of embodiment 142 or 148 to secure one or more sheets 70 to a mattress 50.

168. The method of any one of embodiments 160 to 167, wherein said method further comprises: attaching one or more of the herein-described accessories 300 of any one of embodiments 106 to 141 to the one or more sheet-engaging channels 12 of the corner bracket 10, and/or the side bracket 10 via the at least one accessory connecting member 301 of the one or more of the herein-described accessories 300.

169. The method of embodiment 168, further comprising: adjusting a position of the accessory body 302 of the accessory 300 relative to the one or more sheet-engaging channels 12 of the corner bracket 10, and/or the side bracket 10.

170. The method of embodiment 168 or 169, further comprising: detaching the one or more of the herein-described accessories 300 from the one or more sheet-engaging channels 12 of the corner bracket 10, and/or the side bracket 10.

171. The method of any one of embodiments 160 to 170, wherein said method further comprises: positioning an inflatable bladder 80 under a bracket 10/40 that is positioned so that horizontally-extending bracket component 11 of bracket 10/40 is between a mattress 50 and a support surface 60.

172. The method of any one of embodiments 160 to 171, wherein said method further comprises: connecting an inflatable bladder 80 to a bracket 10/40.

173. The method of any one of embodiments 160 to 172, wherein said method further comprises: connecting an inflatable bladder 80 to aperture 20 of corner bracket 10.

174. The method of embodiment any one of embodiments 171 to 173, wherein said method further comprises: inflating the inflatable bladder 80 to raise bracket 10/40 and the mattress 50 upward in vertical direction $D_V$.

EXAMPLES

Example 1—Preparation of Corner Brackets

A bed sheet retention system comprised of 4 plastic corner brackets (i.e., 4 bed sheet retention devices such as those shown in FIGS. 1-15 and/or described above in embodiments 9 to 59) was prepared. Each bed sheet retention device featured varying heights of locking tracks/sheet-engaging channels to retain bed sheets. The locking tracks featured a streamlined entry and exit, ensuring that bed sheet material did not get bunched up or hung up when inserting the plastic locking strip.

Each corner bracket/bed sheet retention device was 8.5 inches×8.5 inches×4.3125 inches tall. A hole was in the center of the foot/horizontally-extending bracket component of the bracket/bed sheet retention device to reduce the cost of resin required during manufacturing/molding, lighten the product, and improve handling. The clear plastic locking strip was 1-inch-wide×0.0625-inch-thick×15.5 inches long. It had ½ inch radius on the corners making the ends round and the edges were radiused at maximum of 0.03125 inches to give the plastic stripping a very smooth finish without corners or edges. This locking strip slid into 1 of the 1 to 3 (or more if available) retention track selections offered (i.e., sheet-engaging channels offered). These tracks profiles were 1.1875 inches tall×0.1875 inches wide, with radius in the corners. These dimensions provided necessary tolerance for the locking strip to easily slide into the track with a bed sheet trapped in its path. This tolerance also allowed for a secondary locking strip to be inserted, trapping the flat bed sheet as well as another 0.0625 thick locking strip. This optional second strip was to lock into place the flat sheet of the bed at the foot of the bed.

The locking channels interior was radius, providing a smooth journey for the locking strip to run through. The inside lip of the flange was kept at a sharper radius to improve the material wrap and maintain a strong angle for allowing the material to draw the locking strip up into the top of the channel. This edge along with the tolerances was what provided an excellent locking mechanism for the strips and sheeting material. This also allowed for very easy installation of these locking strips.

The corner bracket was designed so that there were up to three channels, which allowed the locking strips to follow. Each sheet-locking channel had a landing, an entry, a locking flange, an exit, a guided corner bend, and then on the perpendicular side at 90 degrees around the corner of the bracket, another landing, entry, locking flange, and exit. This was so that the locking strip can lock the sheet on 2 sides of the corner utilizing a single locking strip.

Each sheet-locking channel was broken up into 3 separate sections: (a) two sheet-locking flanged sides/channels, and (b) an unflanged, open guided channel around the corner of the bracket/bed sheet retention device. The landing on the entry of the corner bracket/bed sheet retention device were 1.0 inch deep to allow for a good seating of the locking strip to stage the entry of collected bed sheet material. The inside of the corner bracket/bed sheet retention device was smooth and had a reinforced radius in the bottom connecting to the bracket's/bed sheet retention device's vertically-extending walls.

The foot pad/horizontally-extending bracket component of the corner bracket/bed sheet retention device was positioned under a mattress and pinned in place. This foot pad/horizontally-extending bracket comprised a large hole as previously described, but its edges were chamfered and tapered to a sharp edge. This edge allowed for the foot/horizontally-extending bracket of the bracket/bed sheet retention device to easily penetrate and slide between the mattress and the foundation the bed sits on. This edge was continuous around the foot of the bracket/bed sheet retention device, allowing for the corner bracket to be inserted from either direction. The large 5.5-inch hole in the center of the foot pad/horizontally-extending bracket component of the corner bracket/bed sheet retention device was radiused to a complete semi-circle which prevented sharp edges and improved handling when holding the bracket/bed sheet retention device. The inside corner wall of the bracket/bed sheet retention device had a radius which matches most industry standard mattresses at 2.5 inches radius. All edges of the bracket/bed sheet retention device were radiused so that there were no sharp edges to damage the sheeting materials.

Alternatives to the above-described bracket/bed sheet retention device were also prepared, including brackets/bed sheet retention devices comprised of male tracks with female type clips, narrow track vents with flat stripping that can hem the sides down, tapered wedges, buttons, snaps, crimps, or the like. All brackets/bed sheet retention devices were simple to use, and could be made in various colors and plastics.

The above-described brackets/bed sheet retention device were produced initially out of a glass-filled polyolefin to insure rigidity. Then, the above-described brackets/bed sheet retention device were produced of either a single solid molded plastic or a multi-part assembled plastic assembly. Cheaper plastics like ABS and the like were used.

The clear locking strip was made from acrylic or polycarbonate. Acrylic was the preferred material for forming clear locking strips given that it was more economical and had great visibility and clarity with great flexibility and rigidity. These locking strips were made with and without a hole at opposite ends and/or a gripping device for the thumb or fingers of a user.

Example 2—Preparation of Side Brackets

Side brackets 40, such as those shown in FIGS. 16-24 and described above in embodiments 60 to 105, were prepared using procedures and materials similar to those described in Example 1. The resulting side brackets 40 were used to secure sheet 70 along the side of a mattress 50.

Example 3—Preparation of Accessories

Accessories 300, such as those shown in FIGS. 25A-29B and described above in embodiments 106 to 141, were prepared using procedures and materials similar to those described in Example 1. The resulting accessories 300 were used by attaching a given accessory 300 to the corner brackets 10 formed in Examine 1 and/or the side brackets 40 formed in Example 2 so as to position at least a portion of the accessory 300 (*i*) above the one or more sheet-engaging channels 12, and/or (ii) below the one or more sheet-engaging channels 12, and/or (iii) within a horizontal plane P containing the one or more sheet-engaging channels 12 of the corner bracket 10 or side bracket 40.

Example 4—Use of Inflatable Bladders

Figure 30C:
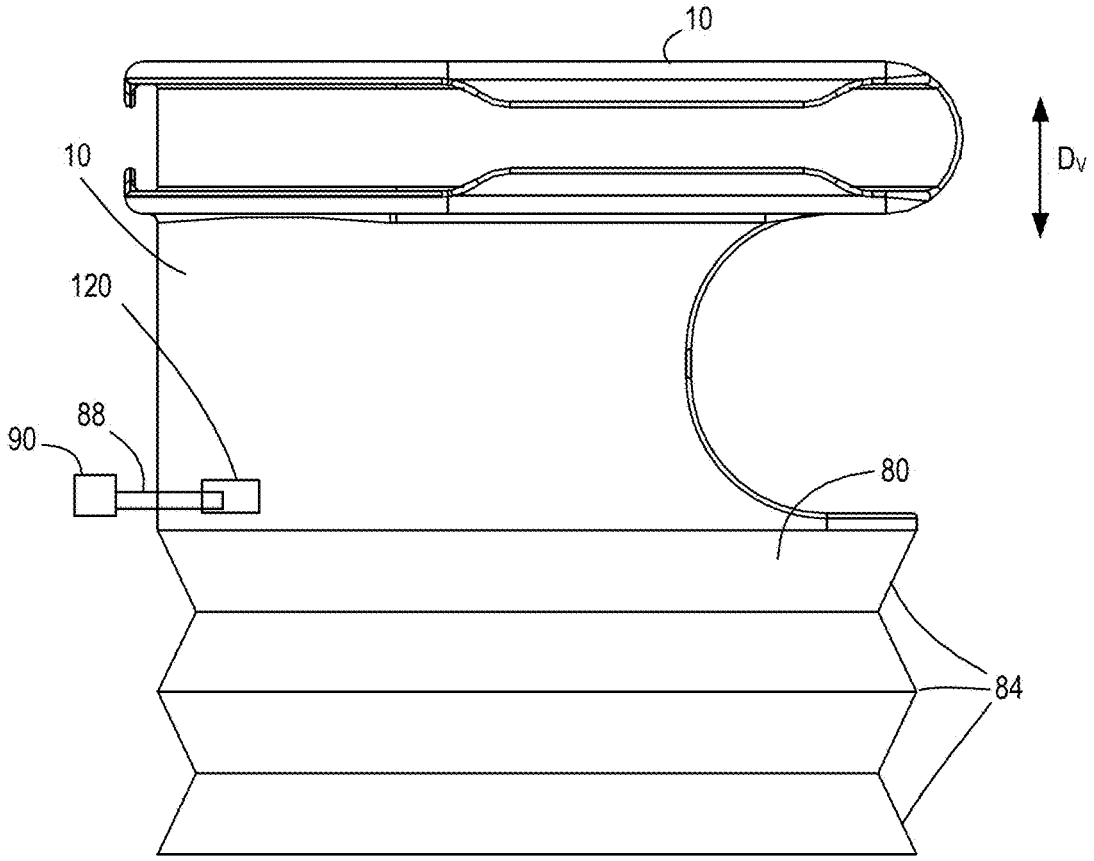

Inflatable bladders 80, such as those shown in FIGS. 30A-30C and described above in embodiments 149 to 156, were prepared using conventional procedures and materials (e.g., rubber/elastic material). Four resulting inflatable bladders 80 were used by (a) attaching a given inflatable bladder 80 to an aperture 20 of one of four corner brackets 10 formed in Examine 1, and (b) positioning the four inflatable bladders 80/corner brackets 10 combination at the corners of a mattress 50. The four resulting inflatable bladders 80 were independently inflated to alter upward/downward a given corner of the mattress 50.

It should be understood that although the above-described bed sheet retention devices, attachable accessories, bed sheet retention systems, and/or methods are described as "comprising" one or more components or steps, the above-described bed sheet retention devices, attachable accessories, bed sheet retention systems, and/or methods may "comprise," "consists of," or "consist essentially of" any of the above-described components, features, or steps of the bed sheet retention devices, attachable accessories, bed sheet retention systems, and/or methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains," "containing," "characterized by" or any other variation thereof, are intended to encompass a non-exclusive inclusion, subject to any limitation explicitly indicated otherwise, of the recited components. For example, a bed sheet retention device, an attachable accessory, bed sheet retention system, and/or method that "comprises" a list of elements (e.g., components, features, or steps) is not necessarily limited to only those elements (or components or steps), but may include other elements (or components or steps) not expressly listed or inherent to the bed sheet retention device, the accessory, bed sheet retention system, and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a bed sheet retention device, an accessory, bed sheet retention system, and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of."

Further, it should be understood that the herein-described bed sheet retention devices, attachable accessories, bed sheet retention systems, and/or methods may comprise, consist essentially of, or consist of any of the herein-described components and features, as shown in the figures with or without any feature(s) not shown in the figures. In other words, in some embodiments, the bed sheet retention devices, attachable accessories, bed sheet retention systems, and/or methods of the present invention do not have any additional features other than those shown in the figures, and such additional features, not shown in the figures, are specifically excluded from the bed sheet retention devices, attachable accessories, bed sheet retention systems, and/or methods. In other embodiments, the bed sheet retention devices, bed sheet retention systems, and/or methods of the present invention do have one or more additional features that are not shown in the figures.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A bed sheet retention system comprising:

one or more corner brackets, wherein each of the corner bracket comprises:

(a) a horizontally-extending bracket component sized and designed to extend between a bottom surface of a mattress and a support surface under the bottom surface; and (b) two or more sheet-engaging channels connected to said horizontally-extending bracket component, with at least two sheet-engaging channels of said two or more sheet-engaging channels (1) being separated from one another by a corner of the corner bracket, (2) extending within a plane P parallel with said horizontally-extending bracket component, (3) each independently comprising (i) an upper sheet-locking channel member, and (ii) a lower sheet-locking channel member positioned below and spaced from said upper sheet-locking channel member, wherein each of said upper sheet-locking channel member and said lower sheet-locking channel member are designed to engage with one or more sheet locking strips, (4) and each independently comprising a channel track profile having a track profile height $H_{TP}$ greater than a track profile width $W_{TP}$.

2. The bed sheet retention system of claim 1, wherein the one or more corner brackets comprises four or more of the corner brackets.

3. The bed sheet retention system of claim 1, wherein said two or more sheet-engaging channels are along one or more outer surfaces of each of the corner bracket.

4. The bed sheet retention system of claim 1, wherein the channel track profile has (i) a track profile length $L_{TP}$ of from about 2.5 inches (in) to about 67.5 in, (ii) the track profile height $H_{TP}$ of from about 0.89 in to about 1.65 in, and (iii) the track profile width $W_{TP}$ of from about 0.1 in to about 0.87 in.

5. The bed sheet retention system of claim 1, wherein the channel track profile has a rectangular cross-sectional configuration.

6. The bed sheet retention system of claim 1, wherein each of the corner bracket further comprises one or more bracket side walls extending from said horizontally-extending bracket component to an upper rim of said corner bracket, and the two or more sheet-engaging channels are positioned along said one or more bracket side walls.

7. The bed sheet retention system of claim 1, wherein each of the corner bracket further comprises two bracket side walls extending from said horizontally-extending bracket component to an upper rim of said corner bracket, and each of the two or more sheet-engaging channels is positioned along one or more bracket side wall surfaces of said two bracket side walls.

8. The bed sheet retention system of claim 1, wherein each of the corner bracket further comprises one continuous bracket side wall extending from said horizontally-extending bracket component to an upper rim of said corner bracket, and each of the two or more sheet-engaging channels is positioned along said one continuous bracket side wall.

9. The bed sheet retention system of claim 1, further comprising:

the one or more sheet locking strips, each of the sheet locking strip (1) being sized and designed to engage with (i) said upper sheet-locking channel member and (ii) said lower sheet-locking channel member, and (2) having a strip width $W_S$ greater than a strip thickness $T_S$.

10. The bed sheet retention system of claim 9, wherein each of the sheet locking strip has a strip width $W_S$ of from about 0.5 in to about 1.5 in, a strip thickness $T_S$ of from about 0.05 in to about 0.10 in, and a strip length $L_S$ of from about 4.0 in to about 18.0 in.

11. A bed sheet retention system comprising:

one or more corner brackets, wherein each of the corner bracket comprises:

(a) a horizontally-extending bracket component sized and designed to extend between a bottom surface of a mattress and a support surface under the bottom surface; and (b) one or more sheet-engaging channels connected to said horizontally-extending bracket component with each of the sheet-engaging channel comprising (i) two sheet-locking members extending along an outer surface of each of the corner bracket, and (ii) an open guided section extending around a corner of the corner bracket and between the two sheet-locking members;

wherein each of the sheet-engaging channel extends within a plane P parallel with said horizontally-extending bracket component, and wherein each of said two sheet-locking members (1) comprises (i) an upper sheet-locking channel member, and (ii) a lower sheet-locking channel member positioned below and spaced from said upper sheet-locking channel member, wherein each of said upper sheet-locking channel member and said lower sheet-locking channel member are designed to engage with one or more sheet locking strips, and (2) comprises a channel track profile having a track profile height $H_{TP}$ greater than a track profile width $W_{TP}$.

12. The bed sheet retention system of claim 11, further comprising:

the one or more sheet locking strips, each of the sheet locking strip (1) being sized and designed to engage with (i) said upper sheet-locking channel member and (ii) said lower sheet-locking channel member, and (2) having a strip width $W_S$ greater than a strip thickness $T_S$.

13. A bed sheet retention system comprising:

one or more corner brackets, each of the corner bracket comprising:

(a) a horizontally-extending bracket component sized and designed to extend between a bottom surface of a mattress and a support surface under the bottom surface; and (b) two or more sheet-engaging channels connected to said horizontally-extending bracket component, said two or more sheet-engaging channels (1) being separated from one another by a corner of the corner bracket, (2) extending within a plane P parallel with said horizontally-extending bracket component, and (3) comprising (i) a first sheet-engaging channel extending in a first direction $d_F$ along said corner bracket, and (ii) a second sheet-engaging channel extending in a second direction $d_S$ along said corner bracket, said second direction $d_S$ being perpendicular to said first direction $d_F$.

14. The bed sheet retention system of claim 13, wherein each of the corner bracket further comprises two bracket side walls extending from said horizontally-extending bracket component to an upper rim of said corner bracket, and each of the two or more sheet-engaging channels is positioned along said two bracket side walls.

15. The bed sheet retention system of claim 13, wherein each of said two or more sheet-engaging channels comprises (i) an upper sheet-locking channel member, and (ii) a lower sheet-locking channel member positioned below and spaced from said upper sheet-locking channel member, and wherein each of said upper sheet-locking channel member and said lower sheet-locking channel member are designed to engage with said one or more sheet locking strips.

16. The bed sheet retention system of claim 15, wherein said upper sheet-locking channel member comprises an upper strip engaging member extending towards said lower sheet-locking channel member, and said lower sheet-locking channel member comprises a lower strip engaging member extending towards said upper sheet-locking channel member.

17. The bed sheet retention system of claim 13, wherein each of said two or more sheet-engaging channels comprises a channel track profile having (1) a track profile height $H_{TP}$ greater than a track profile width $W_{TP}$, and (2) (i) a track profile length $L_{TP}$ of from about 2.5 inches (in) to about 67.5 in, (ii) the track profile height $H_{TP}$ of from about 0.89 in to about 1.65 in, and (iii) the track profile width $W_{TP}$ of from about 0.1 in to about 0.87 in.

18. The bed sheet retention system of claim 13, wherein (1) each of said two or more sheet-engaging channels comprises a channel track profile having a track profile height $H_{TP}$ greater than a track profile width $W_{TP}$.

19. The bed sheet retention system of claim 13, further comprising:

one or more sheet locking strips, each of the sheet locking strip (1) being sized and designed to engage with each of said two or more sheet-engaging channels of said corner bracket, and (2) having a strip width $W_S$ greater than a strip thickness $T_S$.

20. The bed sheet retention system of claim 19, wherein each of the sheet locking strip has a strip width $W_S$ of from about 0.5 in to about 1.5 in, a strip thickness $T_S$ of from about 0.05 in to about 0.10 in, and a strip length $L_S$ of from about 4.0 in to about 18.0 in.

* * * * *